US008435085B2

(12) United States Patent
De Blieck et al.

(10) Patent No.: US 8,435,085 B2
(45) Date of Patent: May 7, 2013

(54) ELECTRICAL CONNECTOR

(75) Inventors: Roland Tristan De Blieck, ET Oss (NL); Gert Droesbeke, Geel (BE); Thierry Goossens, Herdersem-Aalst (BE); Peter Poorter, Wijk en Aalburg (NL)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 13/427,190

(22) Filed: Mar. 22, 2012

(65) Prior Publication Data

US 2012/0178309 A1 Jul. 12, 2012

Related U.S. Application Data

(62) Division of application No. 12/449,709, filed as application No. PCT/IB2008/001682 on Feb. 22, 2008, now Pat. No. 8,182,296.

(60) Provisional application No. 60/903,205, filed on Feb. 23, 2007.

(51) Int. Cl.
*H01R 13/64* (2006.01)

(52) U.S. Cl.
USPC ..... 439/680

(58) Field of Classification Search ..... 439/680
See application file for complete search history.

(56) References Cited

U.S. PATENT DOCUMENTS

| | | | | |
|---|---|---|---|---|
| 4,232,930 | A | 11/1980 | Teti | 339/186 M |
| 5,254,019 | A | 10/1993 | Noschese | 439/681 |
| 5,466,171 | A | 11/1995 | Bixler et al. | 439/378 |
| 5,743,756 | A | 4/1998 | Hasz et al. | 439/364 |
| 5,885,088 | A | 3/1999 | Brennan et al. | 439/680 |
| 6,050,839 | A | 4/2000 | Seminara et al. | 439/364 |
| 6,364,718 | B1 | 4/2002 | Polgar et al. | 439/680 |
| 6,435,891 | B1 | 8/2002 | Beck et al. | 439/248 |
| 6,832,929 | B2 | 12/2004 | Garrett et al. | 439/378 |
| 6,908,330 | B2 | 6/2005 | Garrett et al. | 439/378 |
| 7,121,899 | B2 * | 10/2006 | Homann et al. | 439/680 |
| 7,131,873 | B2 * | 11/2006 | Miyake et al. | 439/680 |
| 7,258,493 | B2 * | 8/2007 | Milette | 385/55 |
| 7,331,827 | B2 * | 2/2008 | Gleissner et al. | 439/680 |
| 7,749,016 | B2 * | 7/2010 | Ikeya et al. | 439/364 |
| 2002/0070702 | A1 * | 6/2002 | Ragnarsson | 320/101 |

FOREIGN PATENT DOCUMENTS

| | | | |
|---|---|---|---|
| DE | 201 07 584 | U1 | 9/2001 |
| EP | 0 443 492 | A1 | 8/1991 |

* cited by examiner

*Primary Examiner* — Truc Nguyen
(74) *Attorney, Agent, or Firm* — Harrington & Smith

(57) ABSTRACT

The present invention pertains to a connector, having a rear side and a mating side and including a housing having at least one contact receiving space and at least one non-contact receiving space, the spaces extending in a direction from the mating side towards the rear side. The non-contact receiving space is adapted for receiving a portion of a mating connector housing and has a substantially rounded cross sectional shape substantially perpendicular to the direction from the mating side towards the rear side.

18 Claims, 22 Drawing Sheets

ELECTRICAL CONNECTOR

CROSS REFERENCE TO RELATED APPLICATION

This is a divisional patent application of U.S. application Ser. No. 12/449,709 filed Nov. 16, 2009 now U.S. Pat. No. 8,182,296, which is a national stage application of International Application No. PCT/IB2008/001682 filed Feb. 22, 2008 which claims priority on U.S. Provisional patent application No. 60/903,205 filed Feb. 23, 2007.

FIELD OF THE INVENTION

The present invention relates to the field of connectors, in particular to electrical connectors. More specifically, the invention relates to the field of safety and robustness of such connectors.

BACKGROUND OF THE INVENTION

The use of a connector and a counterpart, such as a board connector, is widely known for power supply purposes and/or signal transfer. Typically, connectors may comprise a plurality of contacts.

Relatively large forces may be exerted to connectors in a mated situation and/or during the operation of mating, e.g. mating with a relative angling motion. This is especially the case for cable connectors, since the weight of cables may exert a pulling force, possibly with a torsional pulling effect, on a connector. Such (un-)mating or accidental forces may damage or break (one or more portions of) a connector, and thus may lead to undesired, possibly dangerous, situations.

In addition, connectors generally comprise a pair of housing shells or covers covering an interior. In any one of the abovementioned situations, in particular when the connector is placed under torsion-stress, such covers may open partially or wholly, even when the connector is not actually damaged or broken or broken thereby. This may allow undesirable, possibly dangerous, exposure of the interior parts of the connector.

The above-mentioned aspects become increasingly important for connectors for carrying a relatively high voltage, current and/or power.

However, there is also a continuous, conflicting, desire for miniaturisation of connectors which may reduce their strength. Another influencing factor is the manufacturing costs of the connector.

Consequently, there is a desire for an improved connector, especially a power connector for carrying a relatively high current and/or power, which is relatively robust.

Still further, for a number of, primarily economical, reasons identical connectors may be applied for a variety of purposes, e.g. providing or receiving different powers and/or signals. For distinguishing between connectors for different purposes, a coding key or polarisation key, may be provided to a connector for indicating or substantially preventing unsuitable or undesired mating of the connector to a counterconnector and allowing suitable or desired mating. Such a key may be provided as a separate part, to be fitted to a connector in an appropriate manner and position. Thus, one connector design may be used and be appropriately coded for different purposes. The counterconnector may be provided with a corresponding structure for the coding key, such as a receiving space or a coding key being the negative of that of the other connector.

A damaged or broken coding key, and especially one breaking during mating, may allow inadvertent mating of wrong connector pairs. This may lead to a wrong connection, damage or even to danger for an operator.

Further, connectors, especially electrical power connectors, may be connected while charged and/or powered. It is thus important to substantially prevent an operator or foreign objects from coming into contact with the connector contact terminals. The same holds for possible relatively delicate parts of a connector. Such prevention of contact to a connector interior may be obtained by providing an insulating connector housing with bars or touch proof walls. Damage to bars or walls may, again, lead to undesired and possibly dangerous situations.

SUMMARY OF THE INVENTION

An aspect of the invention is a connector having a rear side and a mating side, or front side, and comprising a housing having at least one contact receiving space and at least one non-contact receiving space. The spaces extend in a direction from the mating side towards the rear side. The non-contact receiving space is adapted for receiving a portion of a mating connector housing and has a substantially rounded cross sectional shape substantially perpendicular to the direction from the mating side towards the rear side.

The rounded shape provides reinforcements of side walls defining the non-contact receiving space, or mating connector housing receiving space, compared to straight side walls, since the portions providing the rounded shape may serve as fortifying ribs. At the same time, the rounded shape prevents sharp corners and straight angles where stress may build up. This prevents or at least reduces initiation of cracks and damage to the connector. Moreover, the rounded shape provides relatively accurate guiding in a plurality of direction to a mating connector housing portion inserted in the receiving area, which may prevent the mating connector (housing) getting stuck in the connector during mating and/or forcible twisted mating of the connector and a mating counterconnector.

The connector of can provide an orientation to the receiving area, assisting polarization of the connectors.

The connector is relatively robust since the upper and lower walls and the walls determining the receiving space are joined to other structures and thus are stronger than a free-standing wall of the equal dimensions. Further, the rounded joints assist smoothly distributing forces on the walls over a larger portion of the connector housing. This prevents forces exerted on the walls from focusing at a joint from initiating cracks which may lead to the wall breaking off completely.

In one example the three spaces mutually assist aligning the connector with a mating connector during mating thereof. Further, it allows constructing the connector relatively small while maintaining a relatively large separation between the contact receiving spaces, which may be desirable for insulating the contacts of one or both connectors.

The structures or walls defining the receiving space may assist defining the contact receiving space.

In one example of the connector a side wall of the receiving space serves a double function, allowing a relatively compact build of the connector. The contact and the wall may be configured for mutually supporting or reinforcing each other.

In one example of the connector structures defining the mating connector housing receiving area prevent accidental access to a contact thus forming a touch proof arrangement.

In one example of the connector (the perpendicularly extending portion of) the side wall of the receiving space serves to provide a touch proof arrangement. The perpendicularly extending portion may be formed for guiding and assisting introducing a mating male contact into a female contact in the contact receiving channel.

The connector may suitably be formed as a cable connector.

Another aspect of the invention is a connector, having a rear side and a mating side, or front side, and comprising a housing having at least one contact receiving space and at least one non-contact receiving space. The spaces extend in a direction from the mating side towards the rear side. The non-contact receiving space is adapted for receiving a portion of a mating connector housing. The connector housing comprises a first wall and a second wall extending in a direction from the mating side towards the rear side. The non-contact receiving space, or mating connector housing receiving space, is defined by adjacent side walls oriented substantially perpendicular to the first and second walls and being joined thereto at joints. The side walls have a wall thickness which is larger at the joints than at a position between the joints, such that the non-contact receiving space has a substantially oval cross sectional shape substantially perpendicular to the direction from the mating side towards the rear side.

This connector has relatively robust walls, possibly touch proof walls, and provides a mating connector housing receiving area which reduces the chances of the mating connector getting stuck in the receiving area and damaging the connector.

The invention also provides a connector, comprising a housing accommodating a number of contacts and walls or touch proof walls, wherein two adjacent (touch proof) walls form a mating connector housing receiving area having a general oval cross sectional shape between two contact receiving sections.

This connector has relatively robust housing and it assists mating two contacts to the connector.

Another aspect is a connector, comprising a housing accommodating a number of contacts and walls, wherein two adjacent walls form a non-contact receiving space forming a mating connector housing receiving area and having a general oval cross sectional shape between two contact receiving sections.

The shape of the non-contact receiving space prevents or at least reduces chances of the walls becoming damaged or broken under forces which may occur during mating, compared to substantially straight walls and/or walls with straight angles.

Another aspect of the invention is a mating connector for mating with a connector according to the above descriptions. The mating connector or counterconnector has a rear side and a front or mating side. The connector comprises at least one wall, e.g. a touch proof wall, extending in a direction from the mating side towards the rear side which has a substantially rounded cross sectional shape in a direction substantially perpendicular to the direction from the mating side towards the rear side and which wall is adapted for being received in the non-contact receiving space, or mating connector housing receiving space. This mating connector allows a proper mating to the above-described connector by assisting guiding the insertion and withdrawal action during (un)mating, the wall acting as a guiding feature into the mating connector housing receiving space of the above-described connector.

The cross sectional shape of the wall may be substantially oval or elliptic providing both a rounded shape and a direction for alignment and/or polarisation.

The mating connector may reduce the chances of it getting stuck in the above-described connector and reducing the chances of abusive forces occurring in the early stages of the mating action, wherein only one or a few elements in both connectors may be in contact with each other for guiding the parts into the proper relative orientation.

The connector may further facilitates mating, by allowing a substantially smoothly guided mating action.

In one example of the connector the wall serves as a touch proof wall, substantially preventing inadvertent access to the contacts.

The connector may suitably be formed as a board connector.

One other aspect of the invention is a connector having a rear side and a mating side, comprising a mounting aperture configured for accommodating a coding key. The mounting aperture has a longitudinal axis in a direction from the rear side to the mating side and a plurality of ribs extending in a direction along the longitudinal axis forming grooves therebetween. At least some of the ribs have chamfers on a side wall of the rib. The mounting aperture may be provided with one or more structures for receiving snap lock legs of a corresponding coding key.

This allows insertion and mounting of a suitable coding key into the mounting aperture in a plurality of orientations for defining and/or indicating different connecting arrangements. The chamfers facilitate insertion and mounting of the coding key, e.g. by providing easy entry and an indication of the positions of the ribs and the grooves, thus substantially reducing the chance of wrongly mounting or damaging the coding key. At the same time, one or more ribs may have a continuous height of their extension into the aperture and thus may provide support to the coding key over the full length of the rib.

The connector may provide a substantially symmetric entry of the respective grooves, facilitating mounting of a coding key.

The connector may provide additional support to a corresponding coding key. It also further facilitates mounting a coding key by providing a quite clear indication of the positions of the ribs and grooves.

The connector may comprise relatively robust walls which assist protecting against sideways forces acting on a coding key that may be placed in-between the walls. The walls may serve as touch proof walls, limiting access to contact terminals of the connector.

The connector may comprise a portion for substantially fully capturing and supporting at least a portion of the coding key, providing further protection for the key.

The walls, being joined, also further reinforce the overall structure.

Another aspect of the invention is a connector having a rear side and a mating side, comprising a mounting aperture configured for accommodating a coding key. The connector comprises walls extending in a direction from the rear side to the mating side and being provided with ribs arranged for at least partially enclosing the coding key mounting aperture and for at least partially enclosing a coding key inserted in the aperture.

This connector provides fortified, relatively robust walls for protecting a possible coding key inserted in the coding key mounting aperture, which walls may at the same time suitably serve as touch proof walls.

The connector may comprise a portion for capturing and supporting at least a portion of the coding key, providing further protection for the coding key. It also provides further reinforcement to the walls.

The connector may facilitate mounting a coding key in various orientations, which may allow particular mating arrangements and prevent other mating arrangements.

The connector may facilitate mounting of a coding key.

The connector may provide additional stability and/or support to a corresponding coding key. The connector further provides a relatively clear indication of the positions of the ribs and grooves of the mounting aperture.

Another aspect of the invention is a coding key for a connector as described above. The coding key has a front portion and a rear portion arranged along a longitudinal axis. The rear portion comprises a plurality of deflectable snap lock legs extending substantially in the direction of the longitudinal axis and support structure in-between the legs.

The snap lock legs facilitate mounting of the key into a corresponding mounting aperture of a connector. The support structure provides support and protection for the legs, e.g. during handling and mounting. Preferably, the coding key has two legs, although any suitable number may be provided.

The coding key can assist protecting the coding key by limiting the maximum amount of deflection of legs adjacent the support structure.

In case the coding key has two legs, a single "I" shaped support structure may be appropriate. For a larger number of legs, the support structure may have more arms in cross section. E.g. for a coding key having three or four legs, the support structure may suitably have a general "Y" or "X" shape, respectively, with an "I" shaped portion of the support structure between two adjacent or opposite legs. In one example of the coding key the support structure protects the legs by reducing their exposure from one or more angles respect to the longitudinal axis of the coding key. The support structure may assist indicating how to mount the coding key into the mounting aperture in case a plurality of orientations is possible. The support structure may fit or be received in one or more grooves in the mounting aperture, for absorbing forces on the front portion of the coding key and thus sparing and protecting the legs in a mounted situation.

In one example of the coding key the support structure is reinforced by the ribs. Preferably, the ribs and resulting grooves fit to the grooves and the ribs of a corresponding coding key mounting aperture, thus further assisting alignment of (the legs of) the coding key to the shape of the coding key mounting aperture and providing improved resistance of the coding key to forces on the front portion thereof.

The coding key may facilitate mounting the coding key into a mounting aperture.

The coding key may allow a general rotationally symmetric arrangement of coding key orientations and a clearly visible identification of thereof. Two such keys may be arranged in a mirroring fashion in a suitable mating connector pair, thus providing both connectors with a coding key arrangement and therewith enhancing the safety of (connections with) either connectors.

Another aspect of the invention is a connector having a rear side and a mating side, comprising a mounting aperture configured for accommodating a coding key. The mounting aperture has a longitudinal axis in a direction from the rear side to the mating side and a plurality of ribs extending in a direction along the longitudinal axis forming grooves therebetween. Each of the ribs has a generally flat top end and chamfers on opposite side walls. The connector comprises walls, e.g. touch proof walls, extending in a direction from the rear side to the mating side and being provided with ribs arranged for at least partially enclosing the coding key mounting aperture and for enclosing a coding key inserted in the aperture.

Such a connector comprises a coding key mounting arrangement which provides relatively good protection for the key against abusive forces. The connector is therefore relatively robust and safe.

Another aspect of the invention is a coding key for a connector as described above. The coding key has a front portion and a rear portion arranged along a longitudinal axis. The rear portion comprises a plurality of deflectable snap lock legs extending substantially in the direction of the longitudinal axis and a support structure in-between the legs, e.g. in the form of a raised substantially rigid structure. The support structure has a portion with a substantially elongated or "I" shaped cross-section which extends in a plane in-between two legs which extends beyond the legs in at least one of a direction substantially parallel and a direction substantially perpendicular to the direction of the longitudinal axis and which support structure has a number of ribs extending in a direction along the longitudinal axis and forming grooves or slots between the ribs.

Such a coding key provides protection for the snap lock legs. It may be mounted in a corresponding mounting aperture in a number of orientations wherein the ribs and grooves provide support for the coding key against forces acting on the key from a variety of directions.

The ribs and grooves of the coding key mounting aperture are preferably arranged substantially axisymmetrically and even more preferably (also) substantially symmetrically with respect to the main symmetry-axes of the connector.

The invention will hereafter be fully explained with reference to the drawings showing embodiments of the invention by way of example.

DETAILED DESCRIPTION OF EMBODIMENTS

Figure 1:
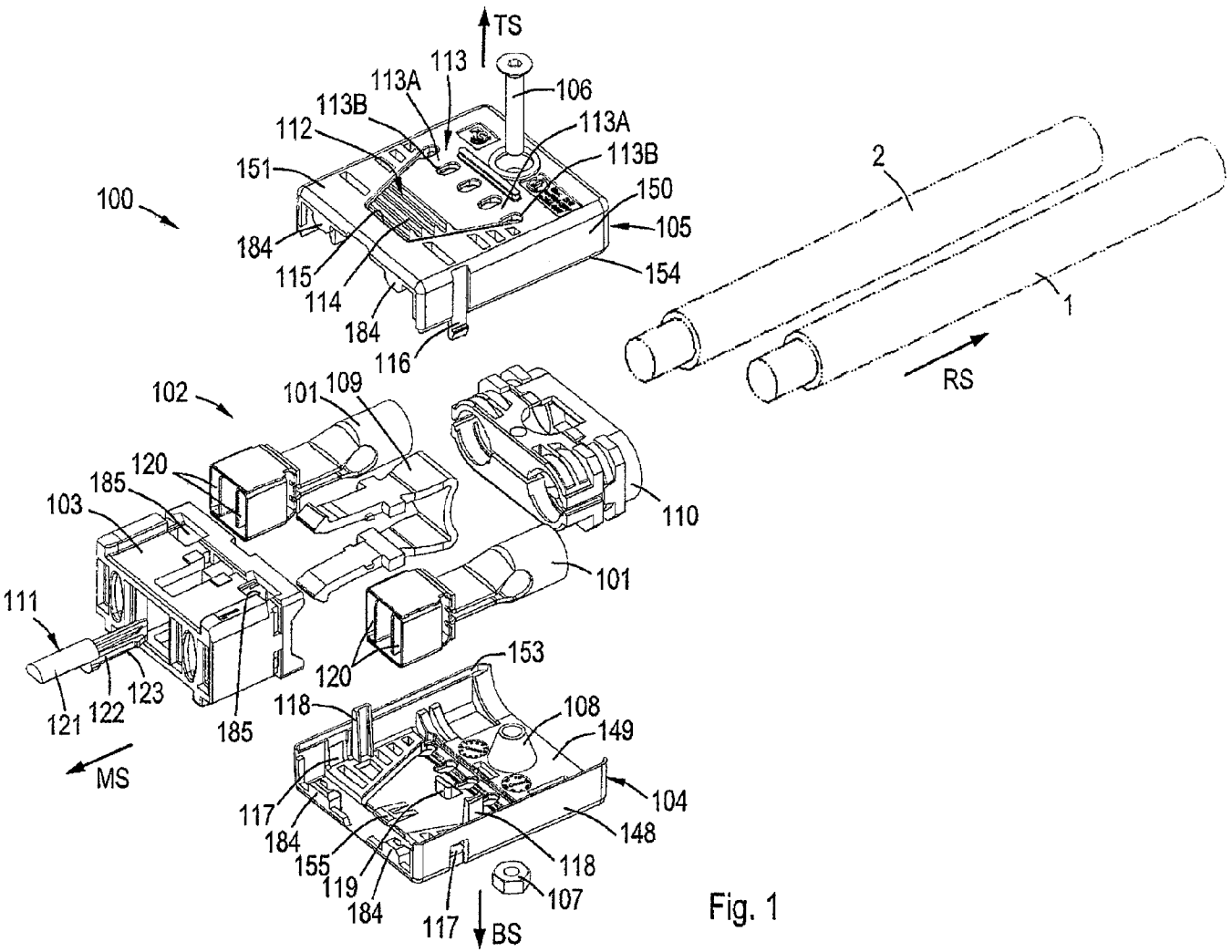
FIG. 1 is an exploded perspective view of a connector.

Referring to FIG. 1, there is shown an exploded perspective view of an electrical connector 100 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used. Further, elements and/or aspects discussed with respect to one embodiment may be suitably combined with those of another embodiment.

FIG. 1 shows a straight cable plug connector 100, adapted for mating with a receptacle mating connector such as the board connector 200 discussed below with respect to, e.g., FIGS. 13 and 28. The connector 100 generally has a front side or mating side MS, a rear side RS, a top side TS and a bottom side BS, the directions being indicated with arrows.

In the following, substantially corresponding or identical parts and portions of different embodiments are indicated with substantially the same reference numerals. Where reference is made to a part or portion of a known connector, corresponding to a part or portion of the improved connector, the respective reference numerals are primed, e.g. a known connector 200' may have a housing 202'.

It should be noted that definitions of orientations and/or sides are mainly for ease of reference and correspond to the parts as shown in the Figures, they should not be construed limiting the disclosure.

The electrical connector 100 is a power connector adapted to removably connect electrical conductors 1, 2 to another electrical connector. The electrical connector 100 generally comprises electrical contacts 101, a housing 102 including a terminal housing 103 and covers 104, 105, fasteners 106, 107, which are accommodated in fastener conduits 108, a locking spring. 109, a strain relief member 110, and a coding key 111.

In the shown embodiment, the fasteners 106, 107 are a screw bolt 106 and a corresponding nut 107. Other fasteners may be envisioned.

The bottom cover portion 104 comprises lateral side walls 148 and a bottom wall 149. The top cover portion comprises lateral side walls 150 and a top wall 151. Along the facing edges of the covers 104, 105, the cover 104 comprises a collar 153 and the cover 105 comprises a collar 154.

The cover portions 104 and 105 of the connector 100 comprise deflectable latch portions 112 with a rear end or base 113, and with finger gripping structures 114 and a front end 115 with an inside ledge 155. The base 113 comprises base portions 113A and holes 113B. The connector 100 further comprises structures for snap locking the covers 104 and 105 to each other in the form of snap lock latches 116, corresponding reception apertures 117 and supporting ribs 118, discussed below with respect to FIGS. 14A-14C.

On the interior side of the covers 104, 105 protrusions 119 are provided for supporting the locking spring 109 as will be explained below. Additional protrusions 184 are arranged for being received in holes 185 in the terminal housing 103.

The shown contact terminals or contacts 101 are configured for receiving an electrical conductor 1, 2 and for being crimped thereto. The contacts 101 are female contacts, each having two substantially parallel contact receiving sections 120 for receiving male contacts of a mating connector, e.g. contact pins or blades. The orientation of the coding key 111 with respect to the terminal housing 103 may determine correct mating between the connector 100 and a mating connector. The coding key 111 has a front keying portion 121, an intermediate portion 122 and a rear mounting portion 123 arranged along a longitudinal axis. In alternate embodiments, e.g. as noted below with respect to connector 300 of FIGS. 16-20, alternative or additional features could be provided. The connector 100 in this embodiment is a straight connector and the conductors 1, 2 extend from the rear side RS of the connector 100. However, features of the invention could be used in a right angle connector. Features of the invention could also be used in a signal connector or a combined signal and power connector. The invention may be used in a "high power" input/output (IO) system, such as 100 Amperes by 20 DC Volts or 25 Amperes by 80 DC Volts for example. The design may use PWR BLADE® contacts (such as those described in U.S. Pat. No. 7,309,242). A general trend is higher current carrying capacity per pin in order to meet high density and still be able to supply high currents to the various components within a system. 2000 Watts at 100 Amperes is not an unusual requirement. The board connector 200 (cf. FIG. 28) may have four generic PWR BLADE® terminals to drive the positive and negative poles of the power (2 contact per pole) and may have a dedicated housing to provide a robust I/O connector system with touch-proof walls and coding in at least four orientations, e.g. defined by a coding key.

Figure 2:
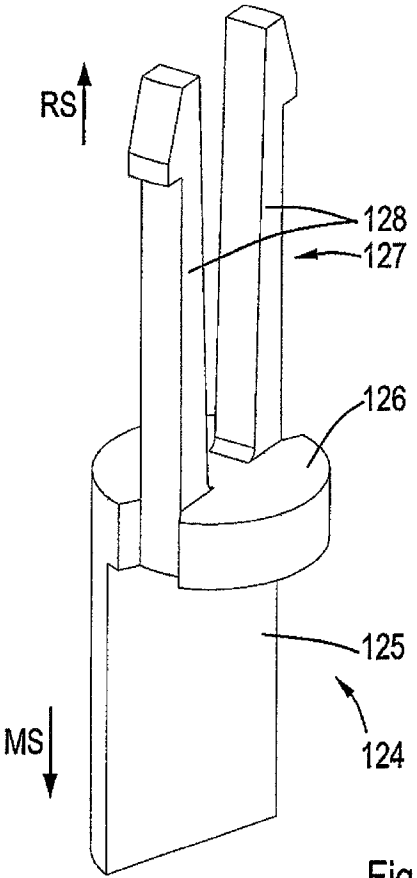
FIG. 2 shows a conventional coding key.

FIG. 2 shows a conventional prior art coding key 124 used in the past. The coding key 124 has a front keying portion 125, an intermediate portion 126 and a rear mounting portion 127.

The rear portion 127 comprises flexible legs 128 for snap lock mounting to a (conventional) terminal housing. A problem with this type of design, it appeared, is that no protection was provided for the flexible legs 128, which were relatively long and too weak to withstand abuse forces. The legs 128 could break or be damaged, thereby causing the front keying portion 125 of the key 124 not to be precisely aligned for mating with a mating coding key of a mating electrical connector. The main problem with the flexible legs 128 is, it appeared, that even after being assembled correctly (there is no damage to the legs in doing so) and well positioned in the housings, they will still break easily under the abuse forces of a mismatch (such as a connector mated in the wrong sense/orientation) and be pushed aside. This problem has been substantially solved with the improved coding key 111.

Figure 3:
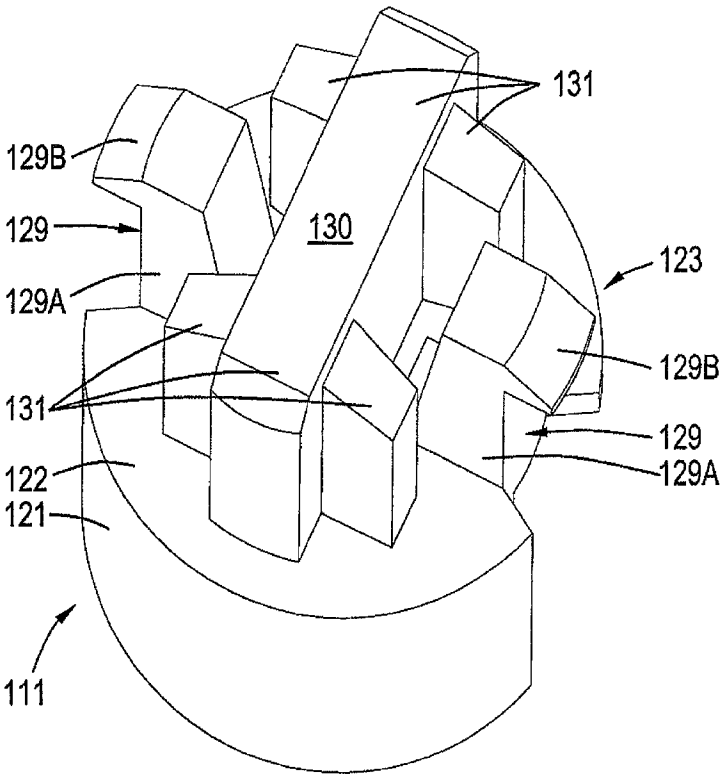
FIG. 3 shows improved coding key.
Figure 5:
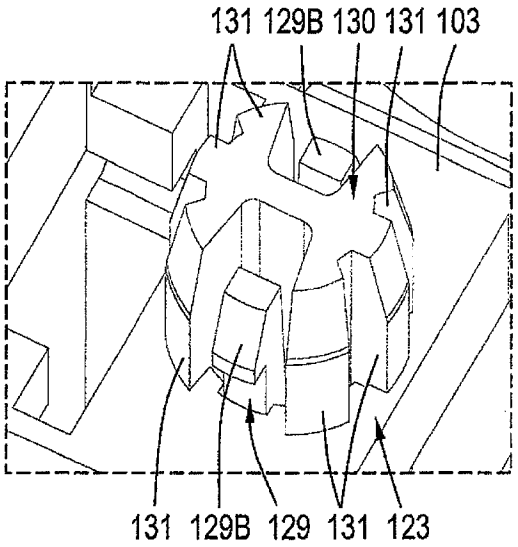
FIG. 5 is an enlarged view from a different viewpoint of the detail indicated in FIG. 4.
Figure 4:
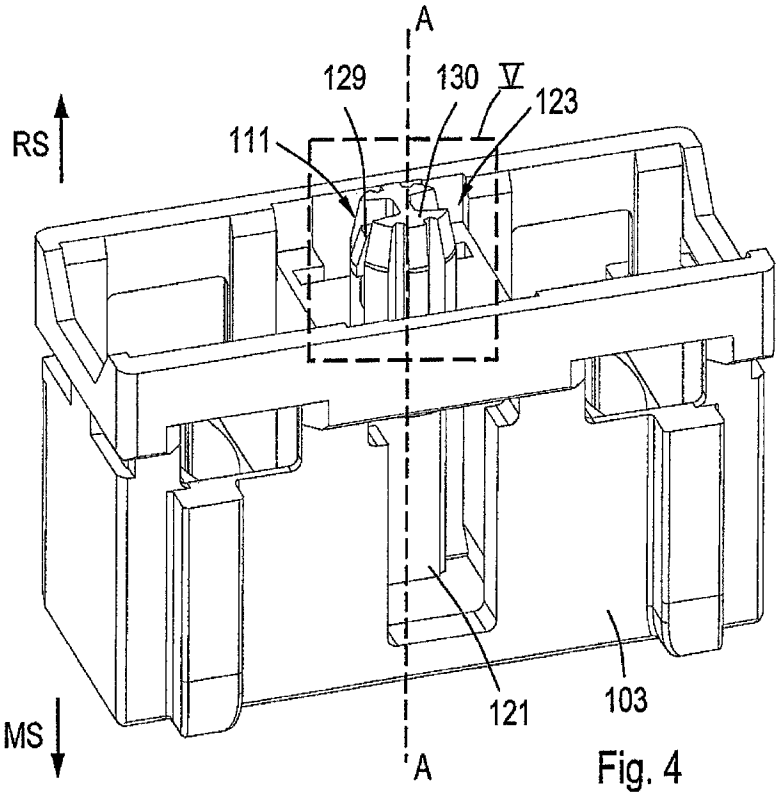
FIG. 4 is a perspective view of a terminal housing with an improved coding key.

FIGS. 3-5 show an embodiment of a coding key 111 according to the present invention. FIG. 3 is a rear view of the coding key 111. FIG. 4 is a rear view of the coding key 111 mounted in a terminal housing 103. FIG. 5 is a detailed view of FIG. 4 as indicated. The coding key 111 has a front keying portion 121, an intermediate portion 122 and a rear mounting portion 123, arranged along a longitudinal axis AA (indicated in FIG. 4). The front keying portion 121 is substantially identical to that of the conventional coding key 124. The rear mounting portion 123 has two deflectable snap lock legs 129, comprising a leg portion 129A and a snap lock latch portion 129B, and a support structure or center section 130 between the two legs 129. The center section 130 has a general "I" shaped cross section with opposite ends of the general "I" shaped cross section each having two side ribs forming a total of three ribs 131 and forming grooves between the ribs 131. The side ribs support and strengthen the "I" shaped portion of the center section 130.

The shape of the support structure 130 can be varied in a number of ways, e.g. in the shape and position of the ribs 131, as may be seen from a comparison of FIGS. 3 and 4. In the embodiment of FIGS. 4 and 5 all ribs 131 are substantially identical. In the embodiment of FIG. 3 the "I" shaped portion of the center section 130 extends beyond the legs 129 in a direction substantially parallel to the longitudinal axis AA and in a direction substantially perpendicular thereto, the "I" shaped portion of the center section 130 being both longer and wider than the legs 129.

In the embodiment of FIGS. 4 and 5, the ribs 131 extend substantially radial with respect to the longitudinal axis AA, and approximately as far as the leg portions 129A of the legs 129. As seen with reference to FIGS. 4 and 5, when mounted to the terminal housing 103 the rear mounting portion 123 of the coding key 111 extends from the terminal housing portion 103 towards the rear side RS thereof.

Figure 6:
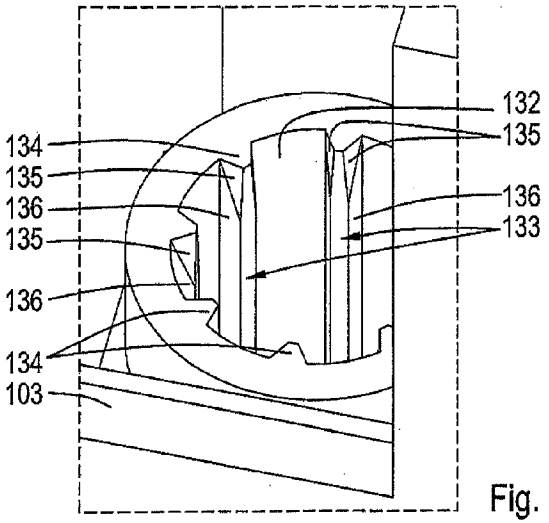
FIG. 6 shows an improved coding key mounting area in a terminal housing.

As seen with reference to FIG. 6, the terminal housing 103 has a mounting aperture 132 for a coding key with eight ribs 133 forming grooves therebetween. The ribs extend in a direction substantially along the axis AA indicated in FIG. 4 with respect to the coding key 111. The rear mounting portion 123 of the coding key 111 is adapted to be snap lock mounted into the mounting aperture 132 in one of eight angular positions. This allows the front keying portion 121, which has a general semi-circular cross-section in this embodiment, to be located in one of eight different keying orientations. In alternate embodiments, the coding key and the mounting aperture could have any suitable number of ribs and/or legs, e.g. four or six, to provide more or less than eight angular mounting positions. In alternate embodiments, the front keying portion 121 could have any suitable cross-sectional keying shape for key mating with a mating coding key in a mating electrical connector.

The leading edges of the ribs 131 of the coding key 111 are preferably chamfered for easy entry into the mounting aperture 132, as shown in FIGS. 3-5. The center section 130 provides support for mounting of the coding key 111 in the aperture 132 and protection for the legs 129.

Figure 8:
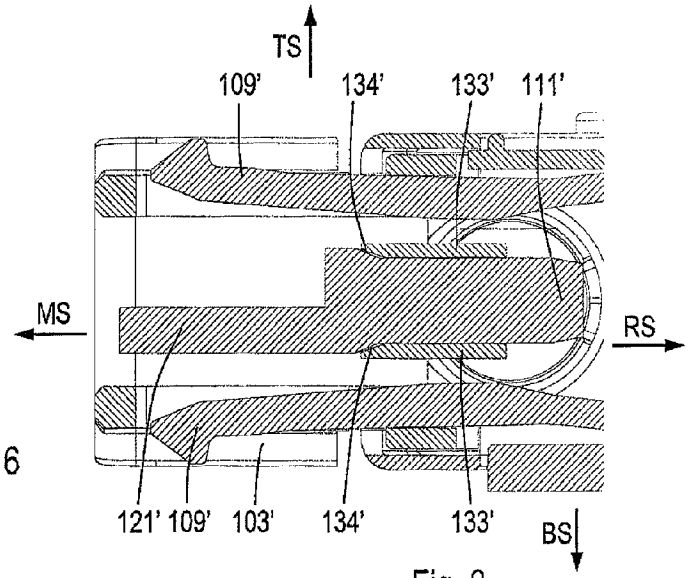
FIG. 8 is a partial cross sectional view of a connector with the coding key mounting area of FIG. 7.
Figure 7:
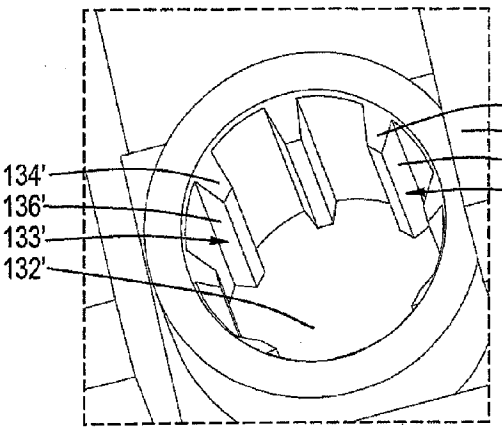
FIG. 7 shows a conventional coding key mounting area.

As seen in FIG. 6, the ribs 133 at the aperture 132 preferably have flat top ends 134 and chamfers 135 on opposite side walls 136 of each rib 133. This provides extra support to the intermediate portion of the coding key 111 (times eight in this embodiment) and a more clear indication of how to mount the coding key 111 into the terminal housing 103, compared to a prix art connector shown in FIGS. 7 and 8. FIG. 7 is a similar view to FIG. 6 and shows a portion of a terminal block 103' with a coding key mounting aperture 132' having ribs 133'. FIG. 8 is a partial cross sectional view of a connector having the coding key mounting aperture arrangement of FIG. 7. FIG. 8 shows a connector 100' with a terminal housing portion 103', a locking spring 109' and two ribs 133' of the coding key mounting aperture 132'. In FIG. 8, a coding key 111 similar to that of FIGS. 3-5 is shown inserted between the ribs 133' with its front keying portion 121 oriented downward in figure.

In the past, as indicated in FIGS. 7 and 8, the ribs 133' had chamfered top ends 134' and straight rib side walls 136'. As shown in FIG. 8, the chamfered lead-in 134' on the ribs 133' gave no support to the coding key and hid the contour and position of the rib 133' at the start of the mounting aperture 132'.

Figure 9:
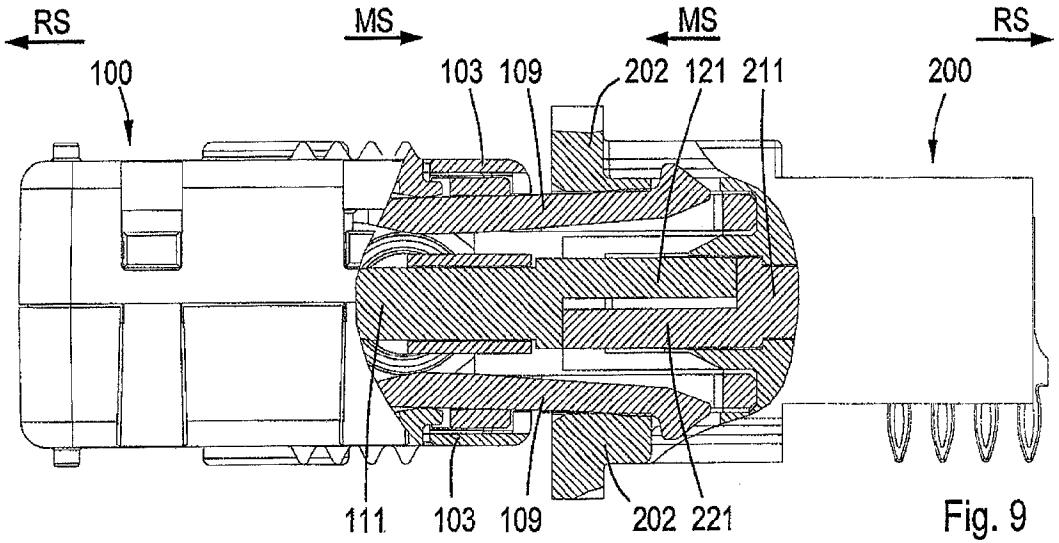
FIG. 9 is a side view, partially broken away, of two mated connectors with matingly oriented coding keys.
Figure 10:
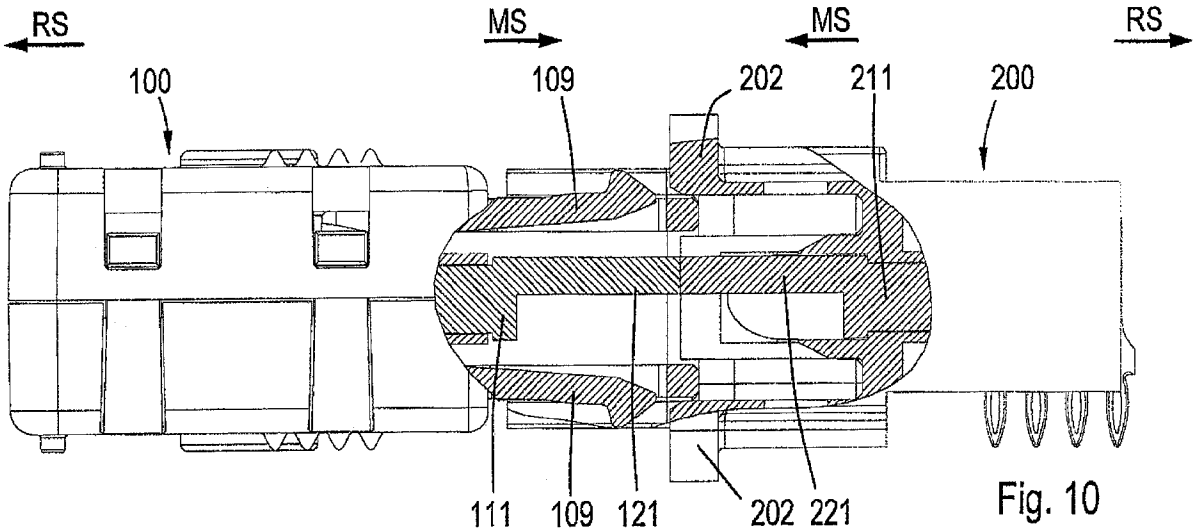
FIG. 10 is a side view, partially broken away of two connectors of which mating is blocked by opposing coding keys.

FIGS. 9 and 10 are views of the connector 100 and a mating connector 200, both partially broken away. Of the connector 100 the terminal housing 103 and the locking spring 109 are visible and also the coding key 111 with its front keying portion 121. The mating connector 200 is a board connector comprising a housing 202 and a coding key 211 with a front keying portion 221. The coding keys 111, 211, or at least the front keying portions 121, 221 thereof, are substantially identical. The coding keys are preferably mounted substantially in a center of the connectors.

Referring also to FIGS. 9 and 10, the coding key 111 allows the electrical connector 100 to be operably mated to a mating electrical connector 200 only if the coding keys 111, 211 are matingly orientated or positioned relative to each other as shown in FIG. 9. If the coding keys 111, 211 are not matingly orientated or positioned relative to each other as shown in FIG. 10, then the connectors 100, 200 cannot be connected to each other.

With the invention the center coding key is capable of taking high abuse forces with limited space consumption, since the center section 130 does not require additional space and further fortifications may not be required.

As noted above, in the past, the coding key 124 had two stand alone flexible legs 128, by which it aligned and locked itself inside a cylindrical cavity 132' of the cable and board connector housing. Furthermore, ribs 133' were placed inside this cavity to create six potential orientations in which you could lock the coding key. As noted above, to make it easy to insert the coding key 124, a big chamfer 134' was added to (the ribs 133' of) the cavity 132'. This solution of providing chamfers 134' had, however, a few major problems summarized above, being in more detail:

The stand alone legs 128 were substantially always subject to abuse forces and broke on many occasions.

Due to the big chamfer/easy entry 134' on the cavity 132' for the coding key 128, it was hard to notice where the ribs 133' inside the cavity 132' were located and, therefore, it was not evident how to position the coding key 128 during assembly.

Due to the big chamfer/easy entry on the cavity 132' for the coding key 124, there was little support of the cavity towards the coding key, and so it was possible to drive the coding key deep inside the cavity when abused. Thus, visual inspection of the position of the coding key could become difficult and the blocking action of opposing coding keys during undesired or incorrect mating could come too late.

The main problem with the flexible legs 128 is that even after being assembled correctly (there is no damage to the legs in doing so) and well positioned in the respective housings, they will still break relatively easily under the abuse forces of a mismatch (connector mated in the wrong sense/orientation) and be pushed aside. Thus, the position and functionality of the coding key may be insecure.

To deal with these problems the invention provides a raised rigid structure 130 in-between and beyond the flexible legs 129 of the coding key 111. This rigid structure 130 was shaped so that:

It would embed the flexible legs 129 and protect it against unintended abuse forces, since the latches 129B could now only be pushed over a limited amount controlled by the profile of the rigid structure 130.

It would fit tightly inside the cavity 132 of the housings 103, 202 like a pillar which is driven deep inside the ground. This substantially always to keep the coding key 111 straight inside the housing 103 when abuse forces are placed upon it, while the related stresses are taken by the rigid structure 130 and, thus, substantially cannot be induced on the flexible legs 129.

It would stretch beyond the flexible legs 129 with its tight fitting to the cavity 132 of the housings 103, 202, so that during the mounting of the coding key 111 the flexible legs 129 would be aligned with their cavity and that these legs are both pushed aside in the same and controlled amount and manner.

It had chamfers/easy entries at the top, here meaning substantially at or near the end of the rear mounting portion 123, which allowed to remove or reduce the chamfer on its cavity 132 and, by doing this, the coding key 111 would get a lot more support from the housings 103,202 and also the operator would now clearly notice the position of the ribs 133 inside the cavity 132 to more accurately position the coding 111 key during mounting.

It had slots or grooves between the ribs 131 which would align themselves around the ribs 136 inside the cavity 132 like a train kept within his tracks; this to make it easy for the operator to mount it in the right orientation and to deal with abuse forces which would try to twist the coding key 111 inside the cavity.

The above listed changes gave already a huge improvement in the robustness and reliability of the coding arrangement, but these were not the only features provided to make the coding more robust while keeping the space consumption the same as before, as will be explained below.

Figure 11:
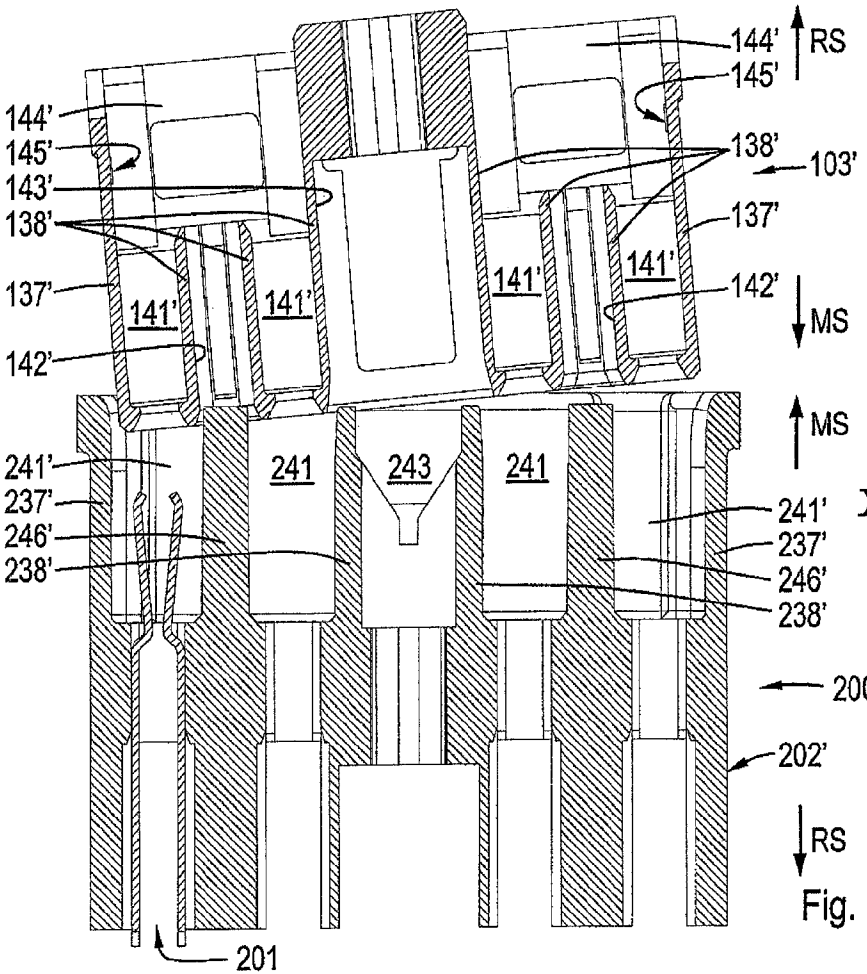
FIG. 11 is a cross sectional view of two partially mated connectors.

Referring to FIG. 11, there is shown a cross sectional view of a prior art terminal housing 103' of a plug connector 100' partially mated with a mating connector 200', the respective mating sides MS facing towards each other and the respective rear sides RS being oriented away from each other. The shape of the walls at the mating side of these connectors 100', 200' is according to a previous design.

Figure 12:
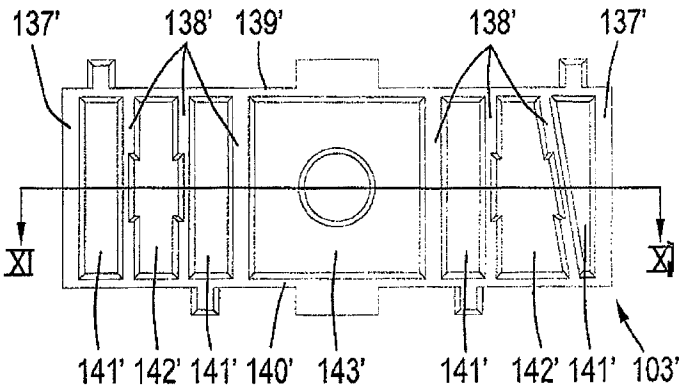
FIG. 12 is a front view of a conventional connector with a broken wall.

FIG. 12 is a front view of the prior art terminal housing 103' from the mating side towards the rear side without a mating connector. The line XI-XI in FIG. 12 indicates the plane of the cross section of FIG. 11.

The terminal housing 103' shown in FIGS. 11 and 12 comprises outside side walls 137', several interior walls 138' a top wall 139' at a top side TS and a bottom wall 140' at a bottom side BS. The walls extend from the mating side MS towards the rear side RS of the connector 100'.

The outside side walls 137', the upper wall 139' and the lower wall 140' define an interior space of the terminal housing 103'. The interior walls 138' divide the interior space into spaces 141', 142', 143', which are open at the mating side MS of the connector. The terminal. housing 103' further comprises two spaces 144' near its rear side. The spaces or contact mounting areas 144' may accommodate a portion of a contact terminal 101', whereas a connected space 141' may accommodate another portion of the contact terminal 101', e.g. a contact receiving section 120' thereof. The spaces 142' may accommodate a portion of (the housing 202' of) a mating connector 200'. A group of adjacent spaces 141', 142', 141' and 144' together forms a contact receiving area 145'. The space 143' may accommodate a coding key.

The mating connector 200' has a housing 202' comprising outside side walls 237' and interior walls 238', together defining spaces 241' and 243' towards the mating side MS of the connector 200' and spaces 244' towards its rear side RS. The spaces 241' and 244' are configured for accommodating a contact 201', here shown as two opposite side wall portions of one male twinblade spade contact. The mating connector housing 202' also comprises walls 246'. The walls extend from the mating side MS towards the rear side RS of the connector 200'. The walls 246' extend further towards the mating side MS than the contacts 201', thus forming touch proof walls 246' preventing accidental access to a contact 201'.

Figure 33:
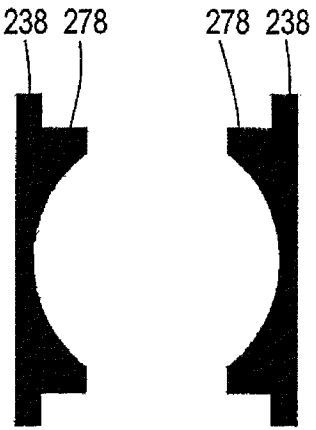
FIG. 33 is a schematic view of the coding key mounting area of FIG. 32.
Figure 34:
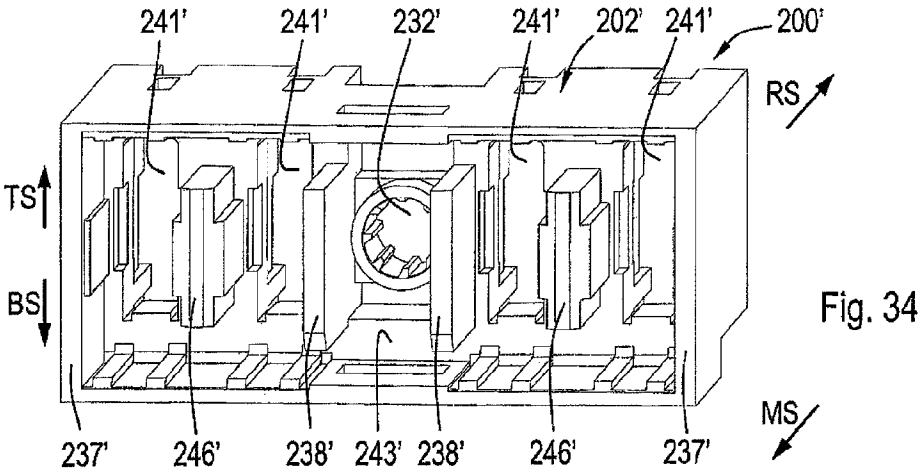
FIG. 34 is a perspective view of a prior art board connector.
Figure 35:
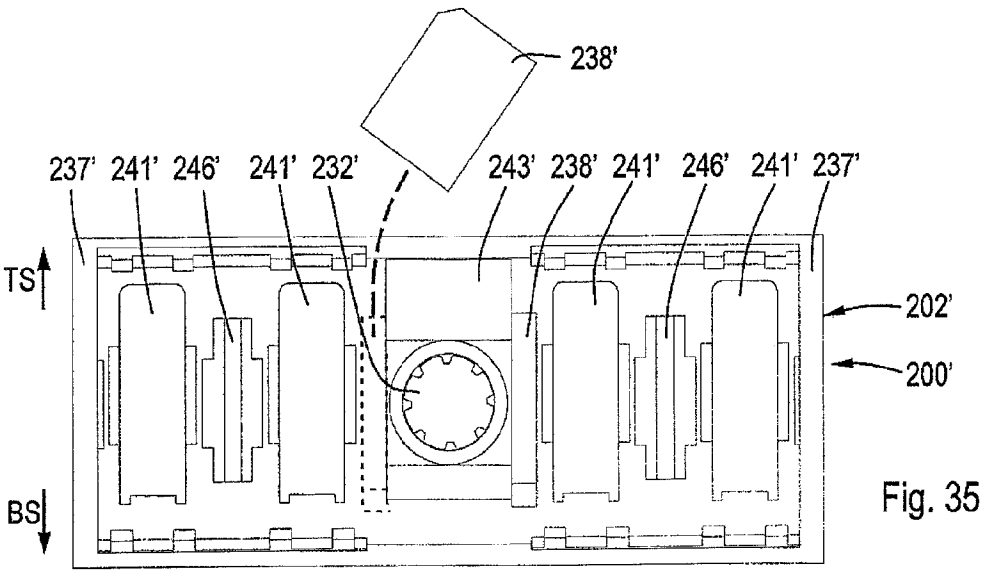
FIG. 35 is a plan front view of the connector of FIG. 34, with a wall broken off.
Figure 38:
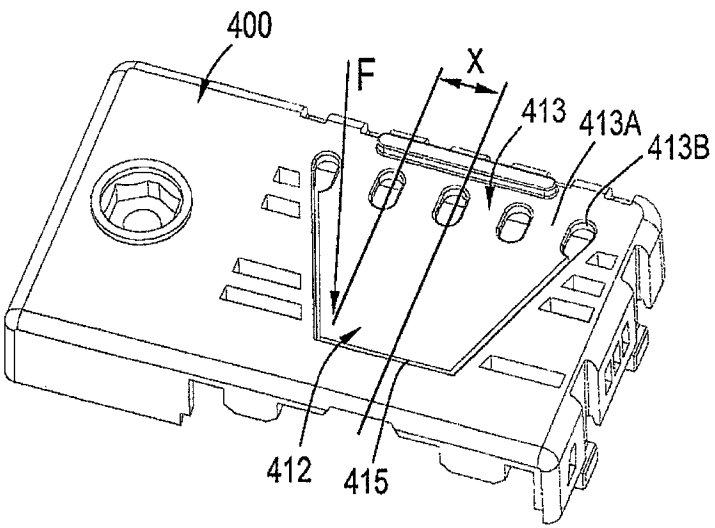
FIG. 38 is a perspective view of a connector cover with a latch button according to an improved design.
Figure 37:
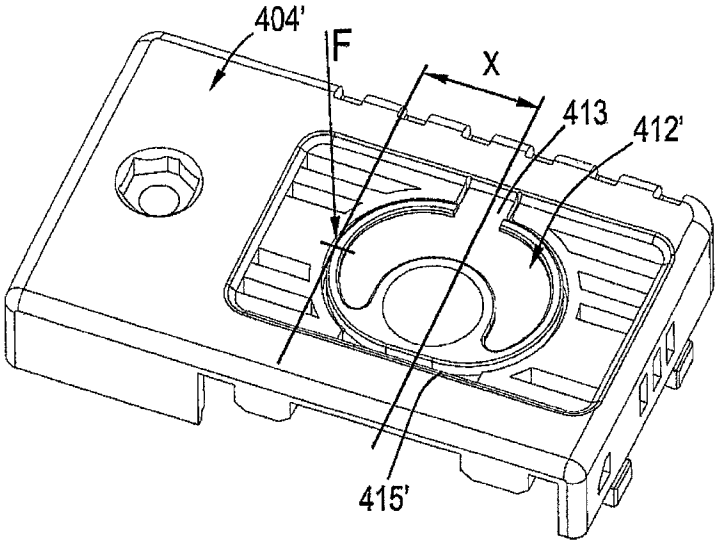
Fig. 37 ( prior art )
FIG. 37 is a perspective view of a connector cover with a latch button according to a prior art design.

In the past, as will also be explained in more detail with respect to FIGS. 32-35, the board connector housing 202' of the board connector 200' was equipped with four stand alone walls 238', 246' in-between the contacts 201' (walls 246') and in-between the contacts 201' and the coding key 211' (238'), to prevent that an operator would have direct access with his finger to the contacts 201' which might be powered. These walls 238', 246', however, broke easily when they got an impact or force from the side (FIGS. 34, 35).

Figure 36:
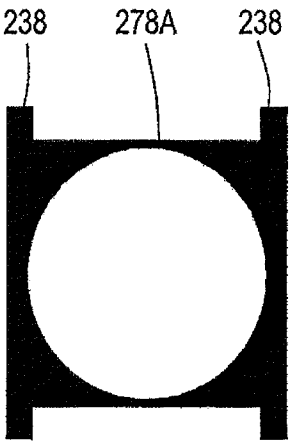
FIG. 36 is a schematic view of a variant of the coding key mounting area of FIG. 32.
Figure 32:
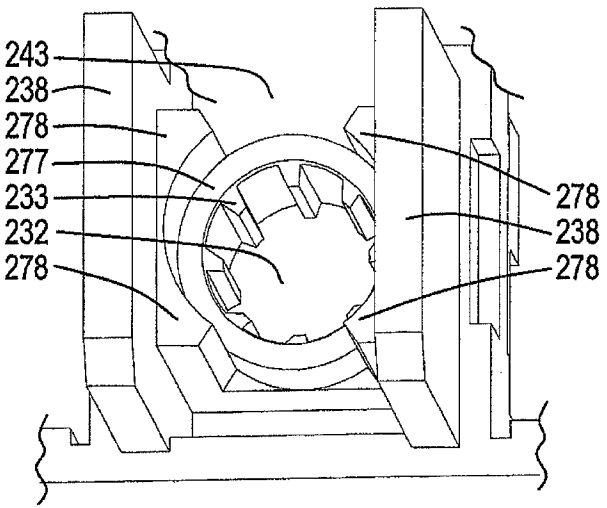
FIG. 32 is a perspective view of a coding key mounting area.

To strengthen the walls 238 in-between the contacts and the coding key, the invention adds C-shaped protrusions 278 to them which would also enclose the coding key 211 and help to keep it straight when abused (FIGS. 32, 33). An alternate embodiment may comprise extending the C-shaped protrusion 278 towards one another to the point where they become one wall 278A and form a rigid tower around the totally captured and supported coding key (FIG. 36).

Referring also to FIGS. 11 and 12, in the past there was a problem when mating electrical connectors were being connected or disconnected if the connectors were twisted or pivoted relative to each other.

A touch-proof housing wall 246' on the housing 202' of the mating electrical connector 200' sometimes caused damage to (the terminal housing 103' of) the housing 101' of the cable electrical connector 100'. It could cause a broken wall 138' in (the terminal housing 103' of) the housing 101 of the cable connector 100' as shown in FIG. 12 (the rightmost wall in FIG. 12). This would interfere with use and mating of the cable electrical connector 100' in the future.

Figure 13:
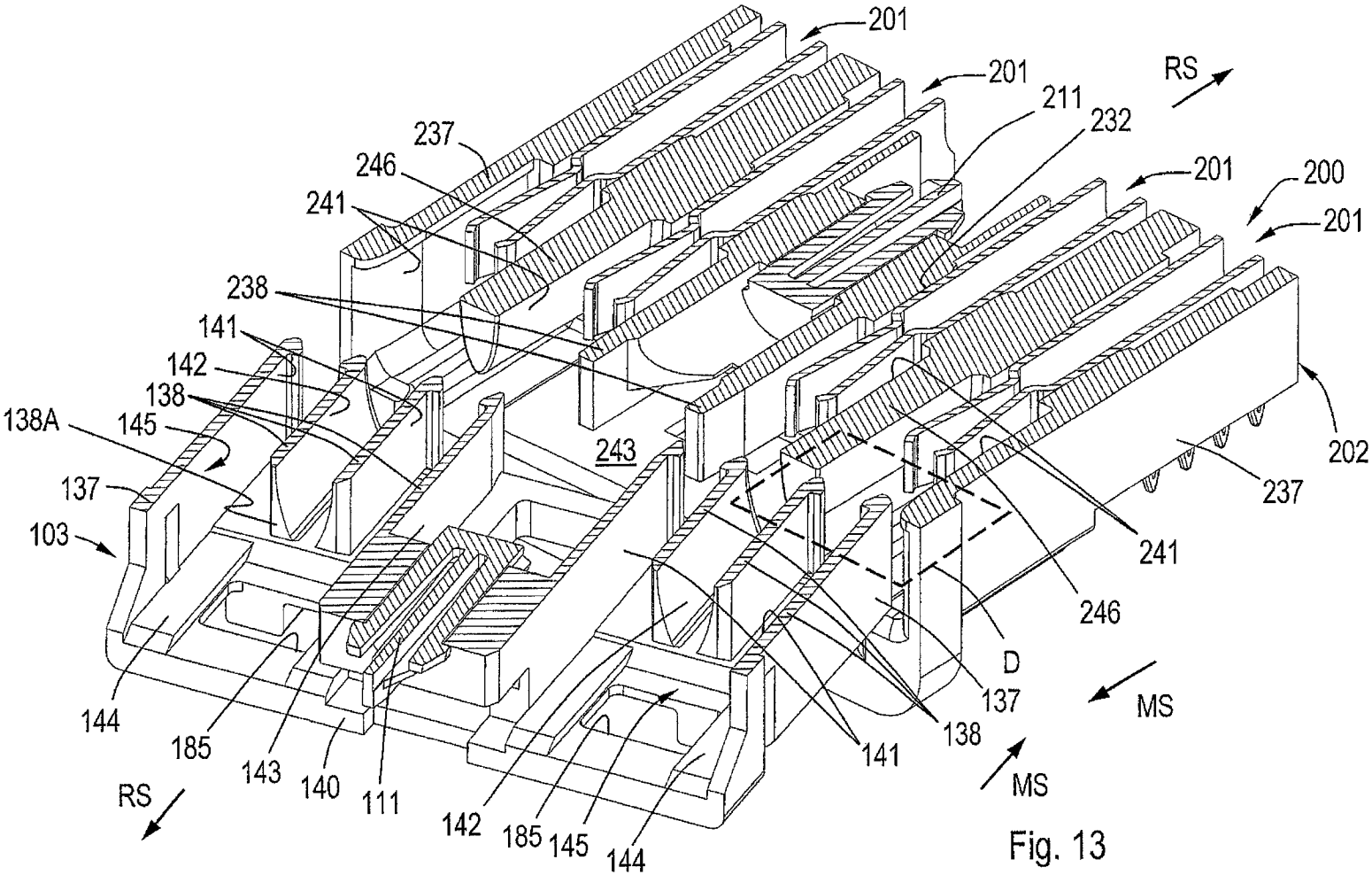
FIG. 13 is perspective view, partially broken away, of two partially mated improved connectors.

FIG. 13 is a perspective view partially broken away of a terminal housing 103 of an improved plug connector 100 partially mated with an improved mating connector 200, the respective mating sides MS facing towards each other and the respective rear sides RS being oriented away from each other. A plan view of detail D indicated in FIG. 13 is shown in FIG. 13D.

Figure 13B:
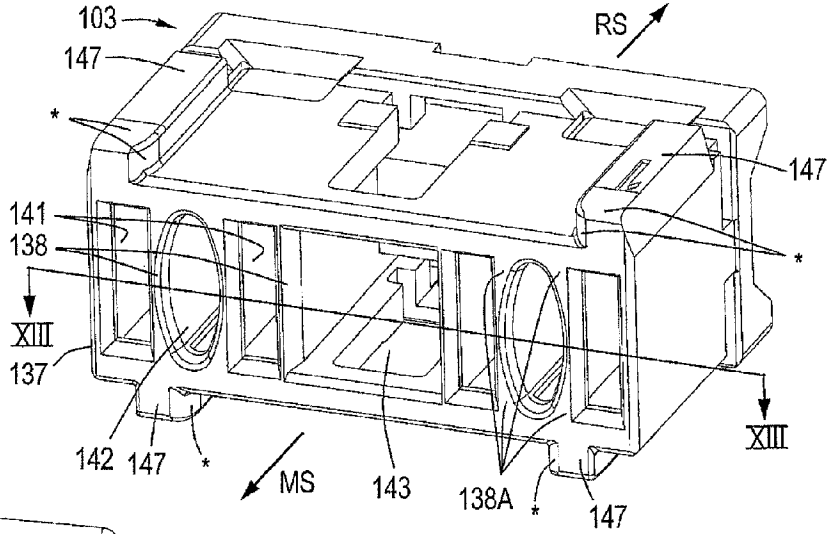
FIGS. 13A and 13B show an improved connector terminal housing.
Figure 13A:
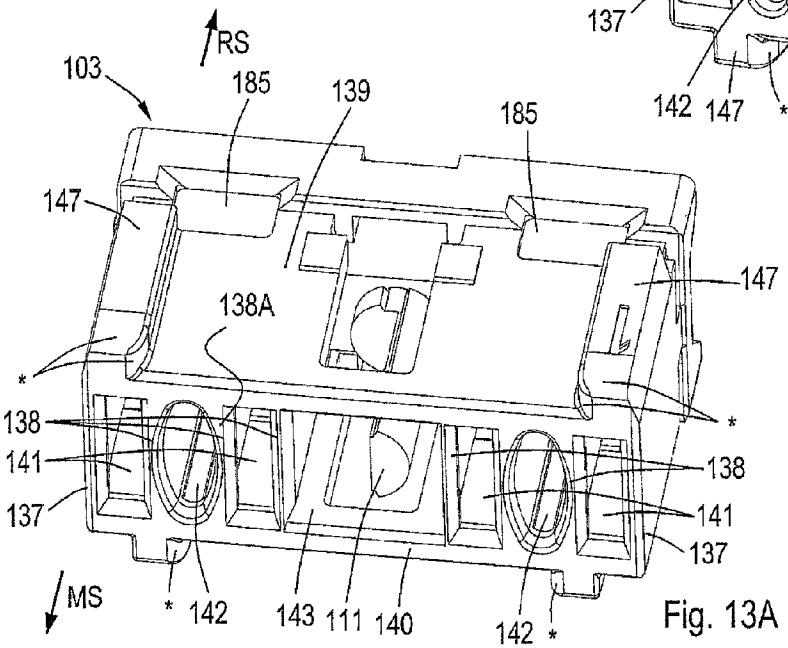
Figure 13D:
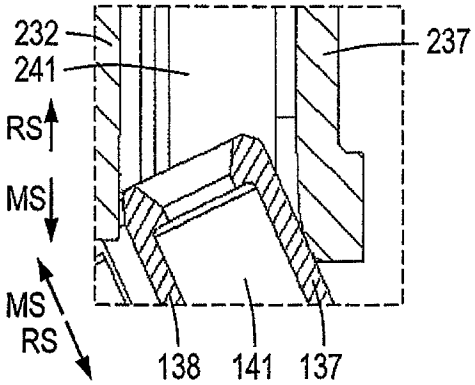
FIG. 13D is a plan cross sectional view of detail D of FIG. 13.
Figure 13E:
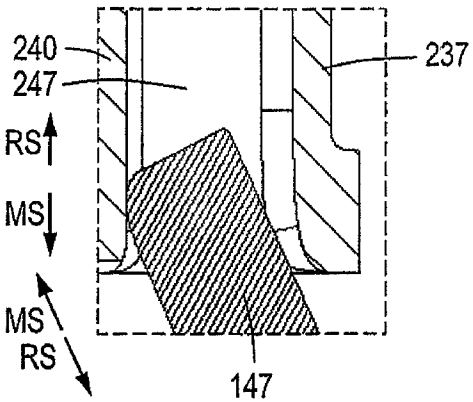
FIG. 13E is a plan cross sectional view similar to FIG. 13D, taken in the plane E indicated in FIG. 13C.
Figure 13C:
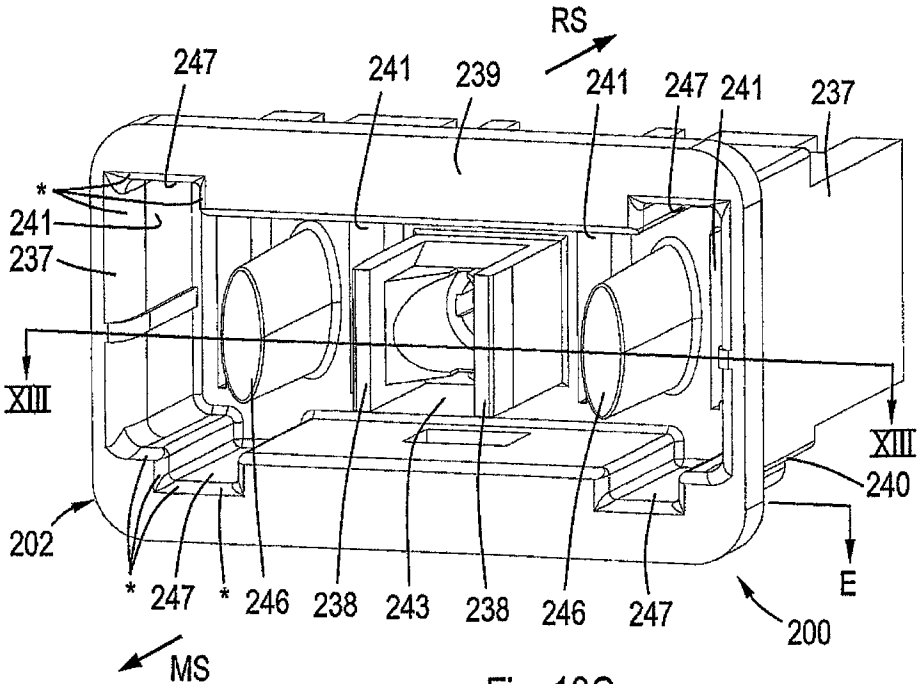
FIG. 13C shows an improved mating connector.

FIGS. 13A and 13B are perspective views of the improved terminal housing 103, one with a coding key 111 fitted (FIG. 13A) and one without (FIG. 13B). FIG. 13C is a perspective view of the improved mating connector 200. In FIGS. 13B and 13C, the cross sectional plane of FIG. 13 is indicated with the lines XIII-XIII. In FIG. 13C, a cross sectional plane E is indicated which is substantially parallel to the plane XIII-XII.

Similar to the terminal housing 103' of FIGS. 11 and 12, the terminal housing 103 of FIGS. 13, 13A, 13B comprises outside walls 137, intermediate walls or separator walls 138, a top wall 139 and a bottom wall 140. The walls 137-140 together form spaces 141, 142, 143 and 144. Spaces 141 and 144 are configured for accommodating portions of a contact terminal. Spaces 141, 142 and 144 together form a contact receiving area 145. Space 143 comprises a coding key mounting aperture 132, optionally fitted with a coding key 111 (FIGS. 13, 13A). The walls 138 are connected with top wall 139 and bottom wall 140 at joints 138A.

Similar to the mating connector 200' of FIG. 11, the mating connector 200 of FIGS. 13, 13C may comprise contacts 201 (four of which are shown in FIG. 13) accommodated in the housing 202. The housing 202 comprises outside side walls 237, interior walls 238 and 246, a top wall 239 and a bottom wall 240, together forming spaces 241 and 243 at the mating side. The walls 246 form touch proof housing walls 246. The space 243 comprises a coding key mounting aperture 232 optionally fitted with a coding key 211 (FIG. 13).

The connector 100, or rather the mating portion of the terminal housing 103, comprises polarization structures in the form of ribs 147. The mating connector 200 comprises corresponding polarisation structures in the form of recesses 247. The polarization structures 147, 247 extend towards the mating side MS of the respective connectors 100, 200. At the mating side MS, the polarization structures 147, 247 are rounded off, forming guiding structures for facilitating mating.

Referring now to FIGS. 1 and 13, the improved terminal housing 103 has been designed to prevent inadvertent damage to the separator walls 138 between the two parallel contact receiving sections 120 of each electrical contact 101. The terminal housing 103 has two contact receiving areas 145 on opposite sides of the center portion 143 of the housing 103 having the coding key mounting aperture 132. Each contact receiving area 145 has two contact receiving spaces or contact channels 141 and a non-contact receiving space or mating connector housing receiving area 142 between the two channels 141. The mating connector housing receiving areas 142 have a general oval cross sectional shape. The portions 246 or touch-proof walls 246 of the housing 202 of the mating electrical connector 200 have matching general oval cross sectional shapes. The general oval cross sectional shape of the mating connector housing receiving areas 142 allow the housing 103 to have thicker portions at the joints 138A which prevent the walls 138 from breaking at the joints 138A (compare with the broken wall 138' in FIG. 12).

The oval shaped touch proof walls 246 on the board connector 200 maximize overall robustness. As mentioned above there are touch proof walls 246 in between the contacts 201, which walls 246' in prior art were rectangular and caused sharp corners on the windows and cavities of the cable connector housing 102, or the portion 103 thereof, and because of which this housing 102 (103) was very fragile. The rectangular shape of prior art board connector 200' is shown most clearly in FIGS. 34 and 35. The invention comprises a change to the shape of these touch proof walls 246 to an oval shape as shown in FIGS. 13, 13C, or to another other generally rounded shape, which allows to round and strengthen the housing 103 of the cable connector 100.

FIG. 13D is a plan cross sectional view of detail D of FIG. 13, showing a portion of connector 100 being partially mated to connector 200. FIG. 13E is a plan cross sectional view similar to FIG. 13D, taken in the plane E indicated in FIG. 13C, showing polarization structures 147, 247 of the partially mated connectors 100, 200 of FIG. 13.

Referring also to FIGS. 13A-13E, to get a good insertion and withdrawal action of the connectors 100, 200 during mating without getting a lever action during rotated insertion/withdrawal, the guiding features (shown indicated with stars (*) in FIGS. 13A-13B) are foreseen of a form which is like or a form close or equal an elliptic radius, a cycloid or forms like this. This reduces the chance of the connector 100 getting stuck and the guiding feature subsequently acting like a crowbar, or rather the fulcrum thereof; risks of breaking the housings 102, 103, 202 of the connectors 100, 200, or portions thereof are therefore reduced. As seen in FIG. 13C, this can also be included in the mating connector 200 (only a portion of the guiding features is indicated in FIG. 13C).

Figure 16:
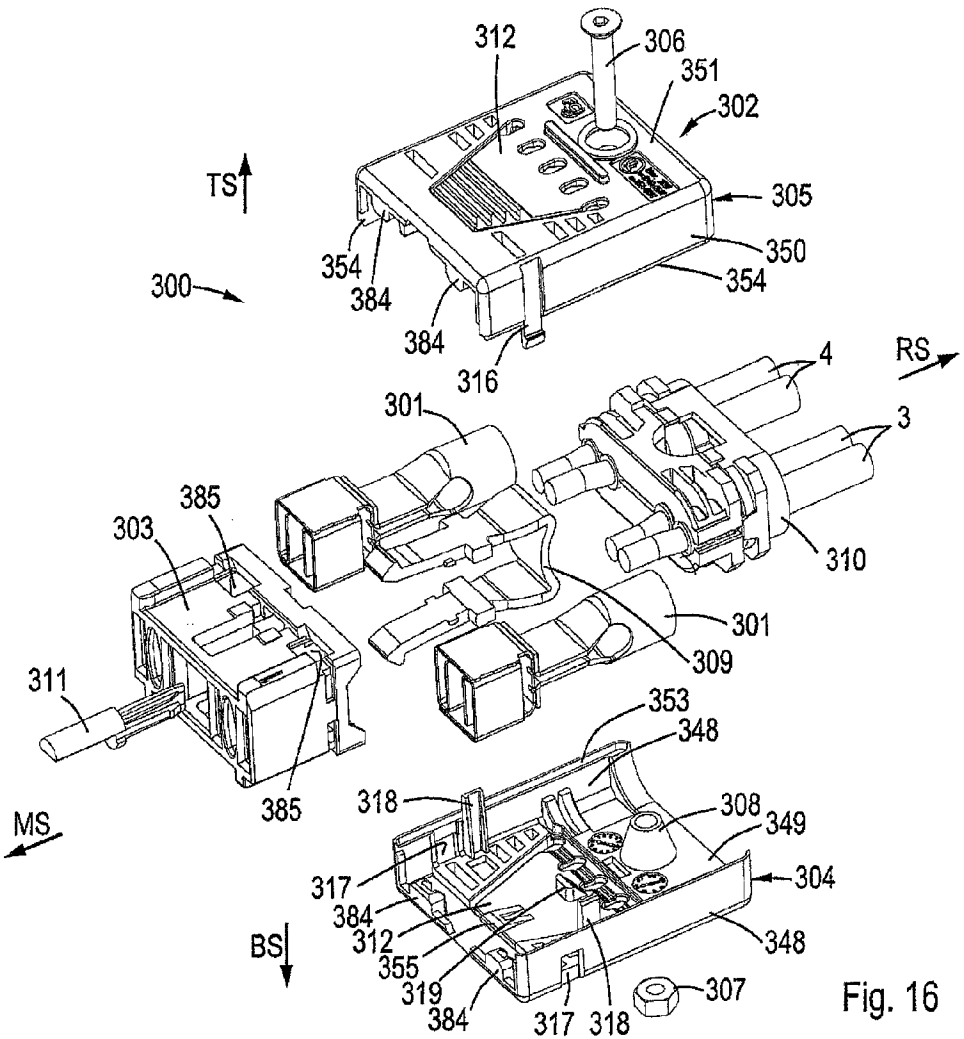
FIG. 16 is an exploded perspective view of a straight connector.

In the embodiment shown in FIGS. 1 and 16, the covers 104, 105 are connected to each other by the fasteners 106, 107, and the front ends of the covers 104, 105 are interlocked with the rear end of the terminal housing 103 with protrusions 184. Similar holds for the embodiments 300 (FIGS. 16-20) wherein covers 304 and 305 are connected to each other by fasteners 306, 307 and the front ends of the covers 304, 305 are interlocked with the rear end of the terminal housing 303 with protrusions 384. The terminal housings 103, 303 may be substantially identical. The covers 104, 105, 304, 305 are preferably one piece members made of molded plastic or polymer material. The top cover 105 (305) has snap lock latches 116 (316) which are received in apertures 117 of the bottom cover 104. The top and bottom covers 104, 105 are shaped to substantially stationarily capture the contacts 101 and strain relief member 110 therebetween. The invention provides a robust cable connector housing or cover assembly 102. The cable connector may have several versions with cable exits in different directions. One of those cable directions is the straight cable connector 100, 300 and in this case the latched covers 104, 105 (304, 305) are less profiled than the angled covers, because of which they are more sensitive to abuse forces which try to drive the one cover half 104 (304) over the other 105 (305) (observed with a clicking sound) or try to twist the covers 102 (302) around the terminal housing 103 (303) in which the cover halves 104, 105 (304, 305) will pop open. In order to tackle this problem, supporting ribs 118 (318; 418) were added on one of the covers, which would reach out to other cover in order to make sure that their side walls will always support one another and, in doing so, follow one another's displacements to keep their hooking features 116, 117 (316, 317) locked. Proper latching may be visually inspected via the apertures 117. These aspects are most clearly visible in FIGS. 14A-14C.

Figure 14A:
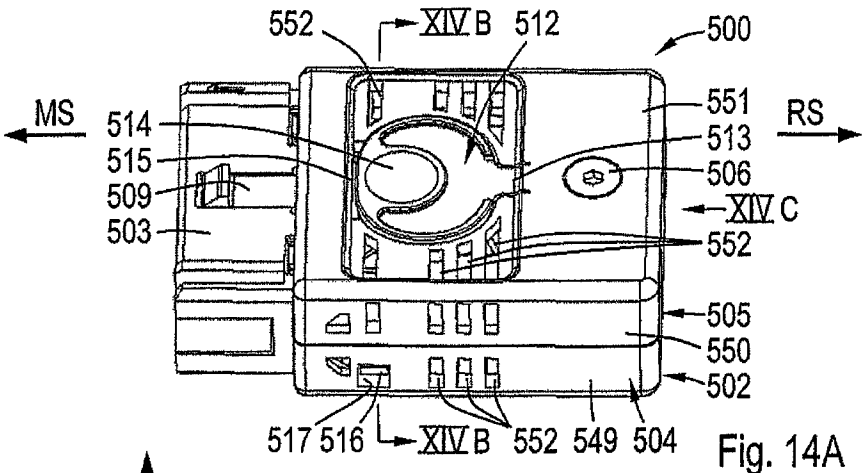
FIG. 14A is a perspective view of a connector comprising an aspect of the invention.
Figure 14C:
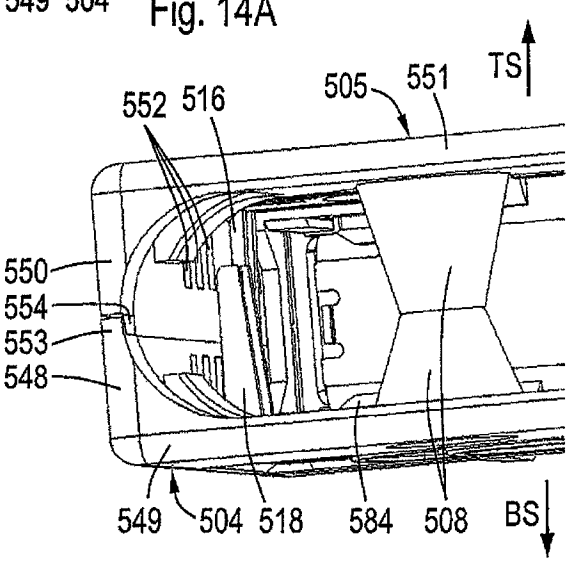
FIG. 14C is a rear perspective view along arrow XIVC in FIG. 14A of the assembled covers of the connector of FIG. 14A.
Figure 14B:
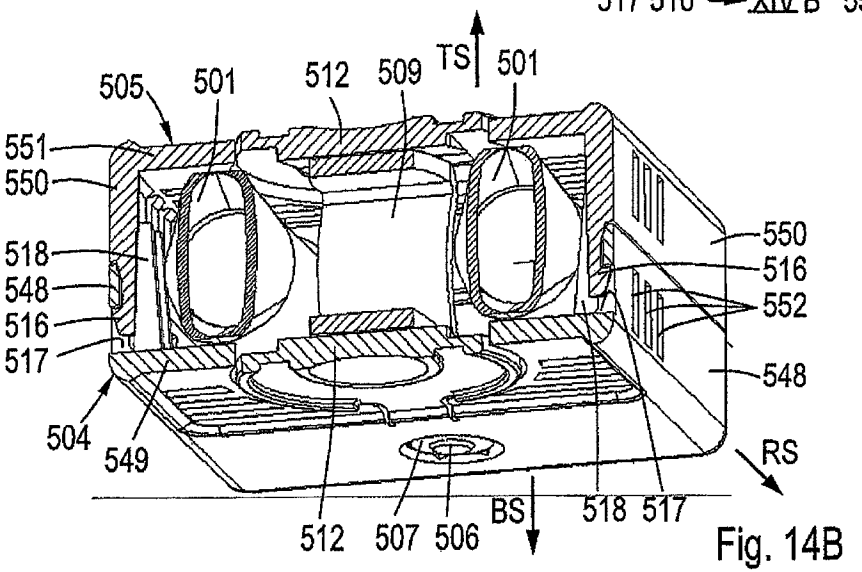
FIG. 14B is a perspective view Of the connector of FIG. 14A, partially broken away along the plane XIVB-XIVB indicated in FIG. 14A.

FIGS. 14A-14C show a views of a straight connector 500 which is substantially identical to connectors 100 and 300.

FIG. 14A is a perspective top view, FIG. 14B is a perspective front view of the connector 500, partially broken away along the cross sectional plane XIVB-XIVB indicated in FIG. 14A. FIG. 14C is a rear perspective view, along the direction of the arrow XIVC in FIG. 14A, of assembled housing covers 504 and 505 of the connector 500 but without other parts of the connector, showing the interior structure of the assembled covers 504, 505.

Figure 40:
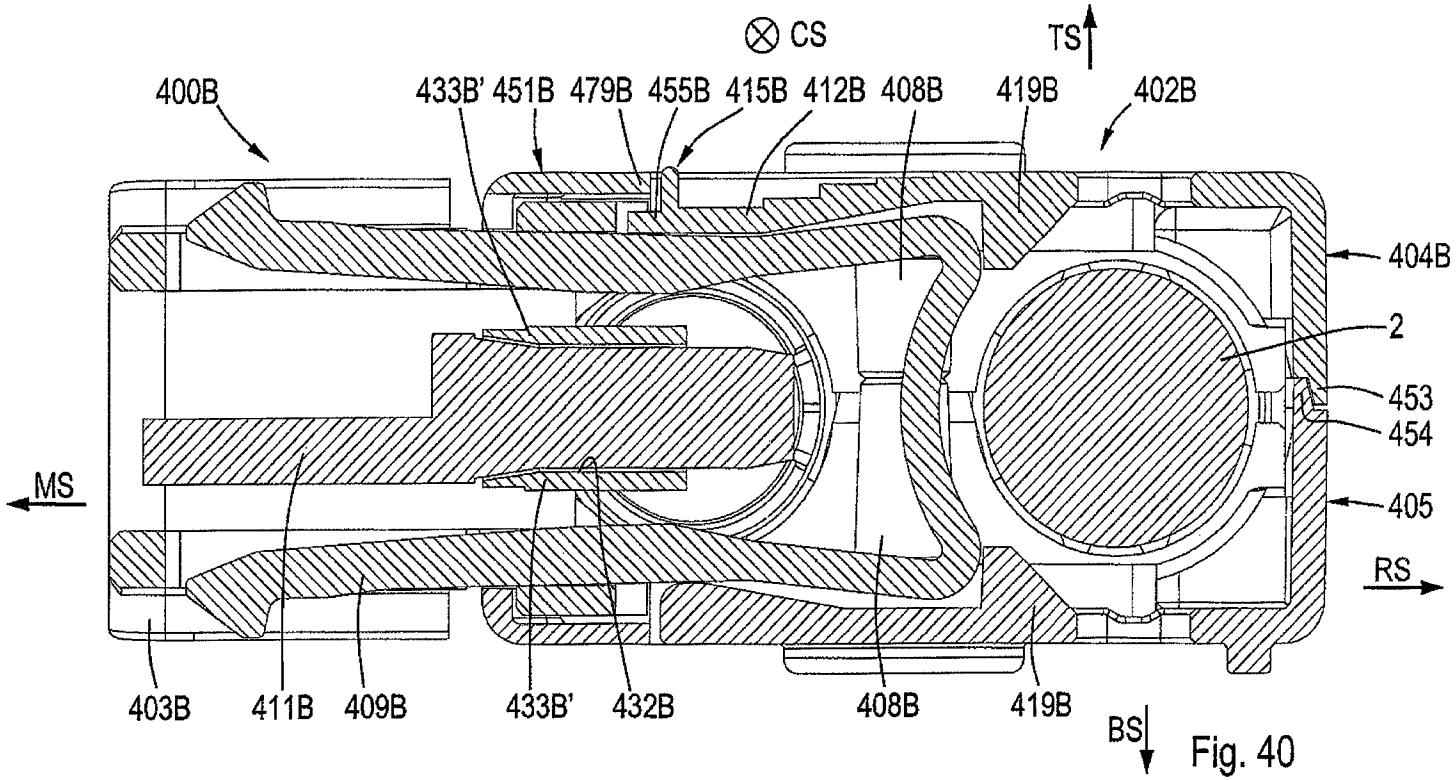
FIG. 40 is a cross sectional view of a right angle connector.

Further, the bottom cover 504 comprises side walls 548 and bottom wall 549 and the top cover 505 comprises side walls 550 and top wall 551, which all comprise ventilation structures or openings 552. The side walls 548 of the bottom cover 504 comprise a collar 553 and the side walls 550 of the top cover 505 comprise a collar 554. The collars may best be seen in FIG. 14C and in FIG. 40 with respect to collars 453 and 454.

The bottom cover 504 includes alignment projections or supporting ribs 518 which project behind the side walls 550 of the top cover 505 which, in combination with the lip/groove edges along the side walls 548, 550 of the covers 504, 505, formed by the collars 553, 554, help to keep the side walls 548, 550 aligned after mating. The side walls 550 of cover 505 cannot collapse inside the side walls 548 of cover 504, as they are blocked by the projections 518. A functionality which is furthermore increased by trapping the collars 554 of cover 505 in-between the projections 518 and the collars 553 of cover 504, these features (518, 553) surround the collars 554 of the cover 505 on both sides like a paper-clip. Since the side walls 548, 550 of the covers 504 and 505 follow one another's side-wards displacements, the latches 516 remain locked in the windows 517.

The collars of side walls may further be provided with additional latching ridges along the facing edges of the collars, for providing additional holding force between the covers.

Figure 18:
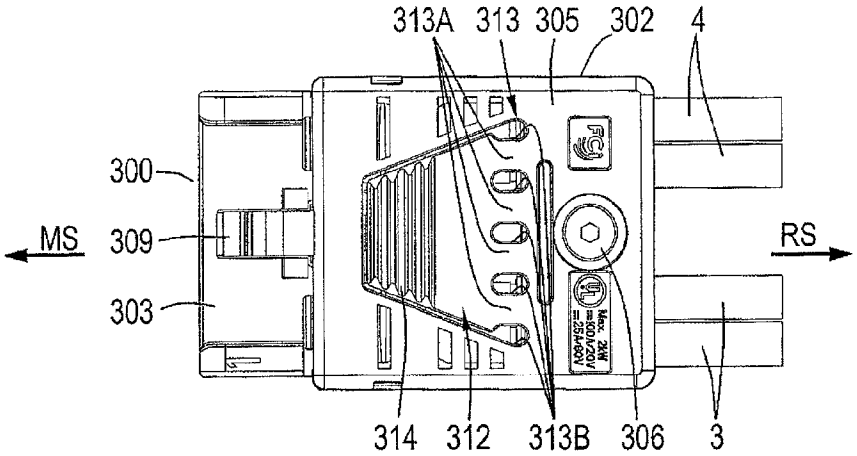
FIGS. 17-20 are different views of the connector of FIG. 16.

Referring to FIGS. 1 and 18, the covers 104, 105 (304, 305) each comprise an integrally formed deflectable latch 112 (312). The latches 112 (312) are adapted to be resiliently depressed inward by the user to unlatch the locking spring 109 (309; 409; 509) from the mating electrical connector e.g. the mating connector 200.

In the embodiments, each deflectable latch 112 (312) has a relatively wide base 113 (313) acting as a hinge of the latch to the rest of the cover 104, 105 (304, 305; 404, 405). As seen most clearly in FIG. 18, with respect to embodiment 300, multiple holes 313B are provided to actually form multiple hinges at the base 313. The front end 315 of each latch 312 is relatively smaller in width relative to the base 313. The latch 312 has a general trapezoid shape. However, in alternate embodiments, any suitable shaped latch could be provided.

In the past, and with reference to connector 500 of FIGS. 14A, 14B wherein this prior design is still used, the buttons 512 to unlatch the cable connector 500 from the board connector only had one hinge 513 which linked them to the rest of the covers 504, 505 and, therefore, since a single hinge is generally relatively weak it was possible for the button 512 to deflect several millimeters outwards of the covers 504, 505 and so become subject to damage/hooking.

Figure 17:
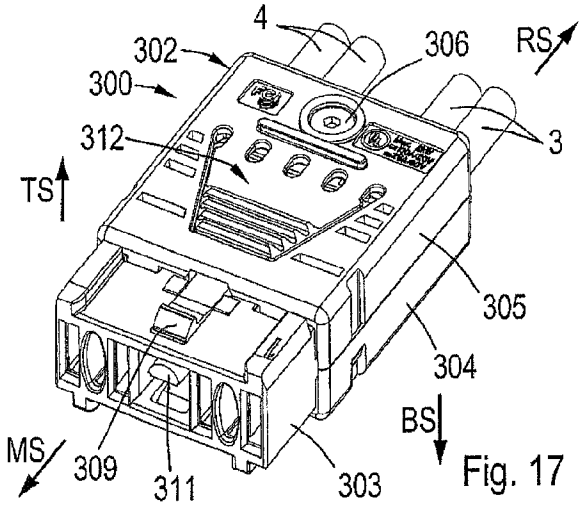

The connectors 100, 300 according to the present invention comprise an improved design which substantially solves this problem, as discussed with respect to connector 300 (in particular FIGS. 16-18).

Figure 39:
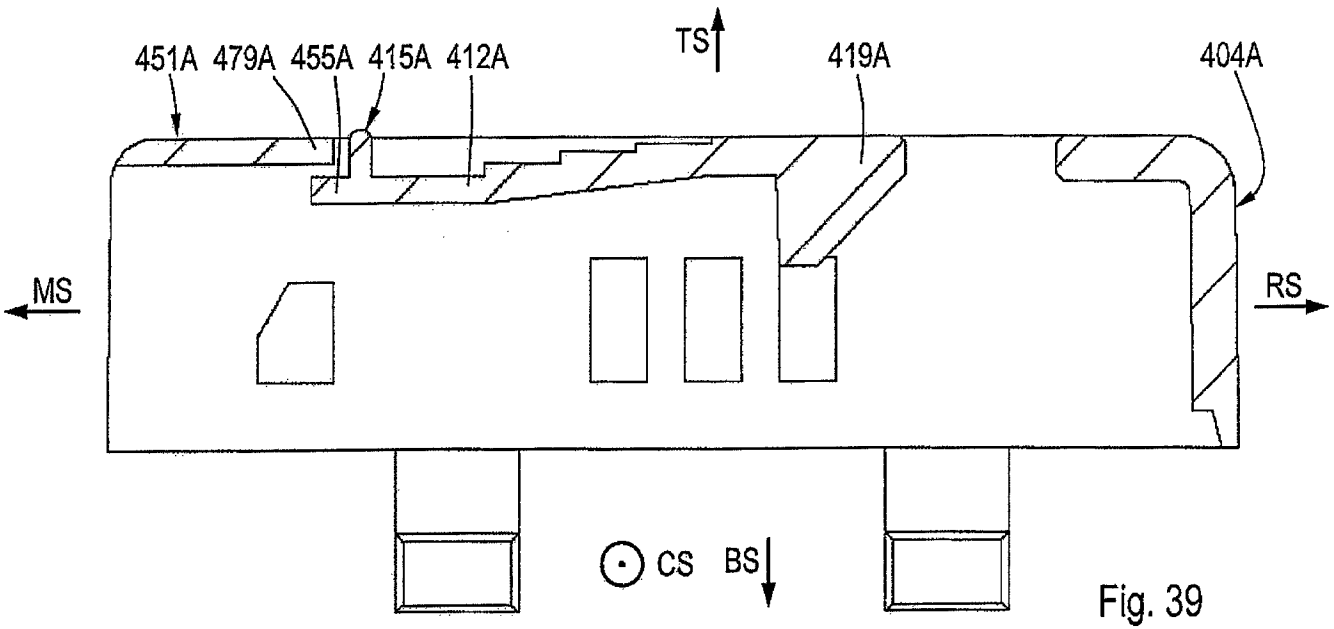
FIG. 39 is a cross sectional view of a cover of a right angle connector.

To make sure that the button would remain protected by the rigid frame of the covers 304, 305 the button, as shown in FIGS. 16 and 39, may include addition of a ledge 355 (see also FIG. 39 which shows a variant) at the front end 315 of the button 312, which would keep it embedded inside the frame of the covers 304, 305 even if it would tend to flex outwards.

To further improve the robustness of the button 312, as shown in FIGS. 17 and 18, its layout was changed from a single hinge (cf. FIG. 14A) to a multi hinge 313, with multiple hinge portions 313A and from an oval shape (cf. FIG. 14A) to a triangular shape (button 312). The multi-hinge 313 does increase the robustness, as you have more material, e.g. plastic, to take the forces and you need to break a plurality of hinges 313A, here four hinges 313A, instead of one hinge (513) before the button 312 (or 512, respectively) comes loose. Furthermore the holes 313B provide extra ventilation holes to dissipate the heat that may be generated by the mated and powered terminals of mated connectors. The multi-hinge 313 does not prevent the outwards deflection of the button, for that you need the ledge 355 on the interior side of the bottom wall 349 or top wall 351 of the covers 304, 305, respectively. In the connectors 400A, 400B of FIGS. 39, 40 the functionality of the ledge 355 is provided by a lip portion 455A (455B) of a button 412A (412B) underneath a cover wall top portion 451A (451B).

Figure 15B:
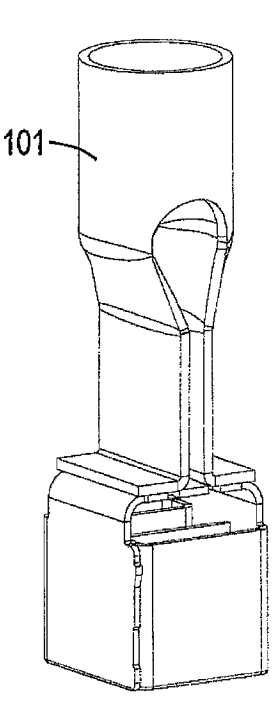
FIGS. 15A-15B show a contact and its assembly.
Figure 15A:
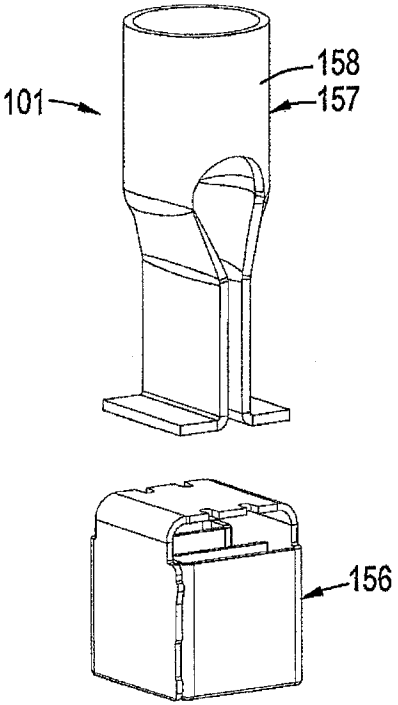

Referring now to FIGS. 1 and 15A-15B, the electrical contacts 101 each generally comprise two members 156, 157 which are mounted to each other, such as by a soldered connection or ultra sonic welding. However, in alternate embodiments any suitable type of electrical contacts could be provided. The first member 156 forms the front mating end of the contact and the second member 157 forms the rear end of the contact. The rear end 157 has a barrel section 158 which is adapted to receive an end of one of the electrical conductors 1. The barrel section 158 can then be crimped onto the conductor. The electrical contacts 101 and alternatives will be discussed in more detail below.

Figure 20:
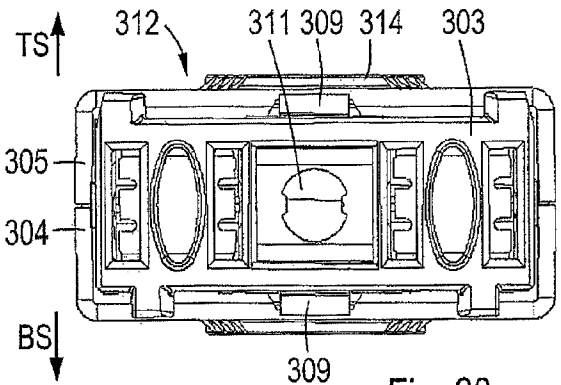
Figure 19:
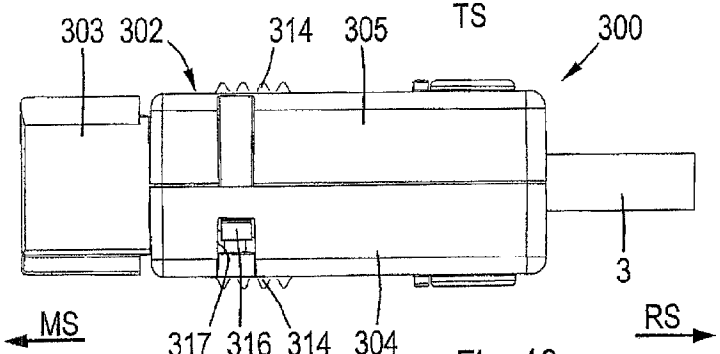

FIGS. 17-20 are different views of the connector 300 in assembled state; FIG. 17 is a perspective view, FIG. 18 is a top view, FIG. 19 is a side view and Fig. 20 is a view from the mating side towards the rear side of the connector 300.

Figure 23:
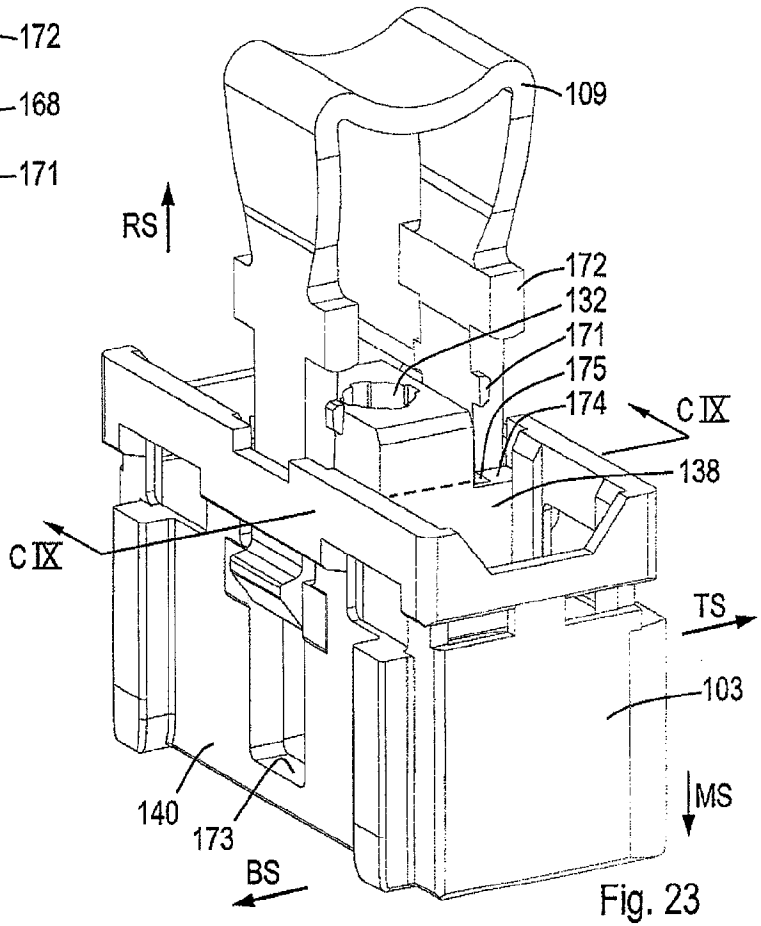
FIG. 23 is perspective view of the locking spring of FIG. 21 partially mounted to a terminal housing of a connector.
Figure 22:
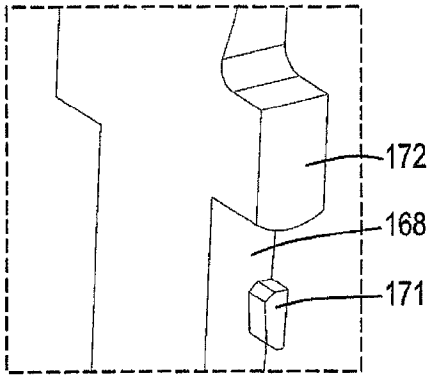
FIG. 22 is a detail of FIG. 21 as indicated in FIG. 21.
Figure 21:
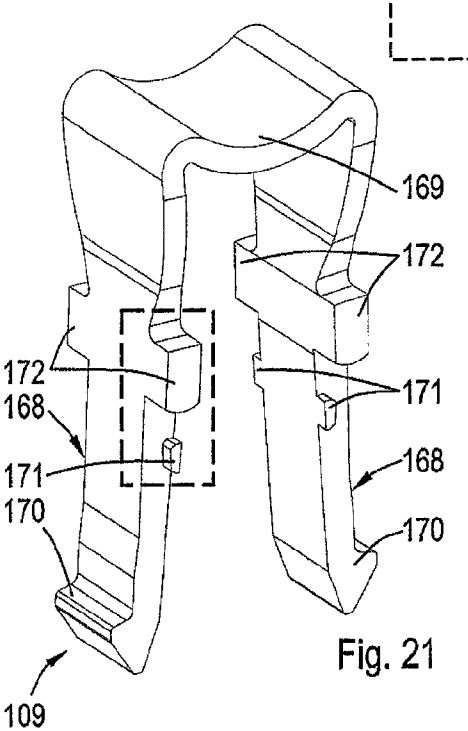
FIG. 21 is a perspective view of a locking spring.
Figure 27A:
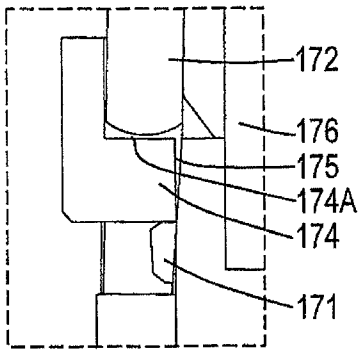
FIGS. 25-27A show the assembly and operation of the locking spring of FIG. 21 in a connector terminal housing, FIG. 27A showing detail A of FIG. 27.

FIG. 21 shows a perspective view of the locking spring 109. FIG. 22 is an enlarged view of the detail indicated in FIG. 21. FIGS. 23-27A show the assembly and operation of the locking spring 109 in a connector terminal housing 103, with FIGS. 25-27 being cross sectional views along the plane CIX-CIX in FIG. 23 and FIG. 27A showing detail A of FIG. 27.

The locking spring is adapted to removably lock the connector 100 with the mating connector 200 with a snap-lock connection (see also FIG. 9). The locking spring 109 has a general "U" shape with deflectable cantilevered legs 168 and a connecting portion 169. Ends of the legs 168 have snap lock ledges 170. The snap lock ledges 170 allow for removable latching with the mating electrical connector 200. As shown in FIG. 22, lateral sides of the legs 168 have locking structures or locking tabs 171. The lateral sides of the legs 168 also have enlarged contact projections 172 for contact with the deflectable latches 112 on the covers 104, 105 (see FIG. 1). When the deflectable latches 112 on the covers 104, 105 are depressed inward by a user, the latches 112 can deflect the legs 168 towards each other; thereby disengaging the snap lock ledges 170 from the mating electrical connector.

FIG. 23 is a perspective view from the bottom side of the locking spring 109 partially mounted to the terminal housing 103. The terminal housing comprises grooves 173 in its bottom wall 140 and in its top wall 139 (not shown). In FIG. 23 a rear portion of an intermediate wall 138 may be seen. The wall 138 extends towards the rear side RS of the terminal housing 103 and forms part of the coding key mounting aperture 132, which here comprises only four ribs with grooves in-between.

As seen in FIG. 23, the locking spring 109 is initially mounted to the terminal housing 103 with the ends of the legs 168 in grooves 173. The terminal housing comprises a rib structure 174 extending from the intermediate wall 138 having a recess 175 through which the locking tabs 171 passes, as will become more clear from FIGS. 24-27A.

Figure 27:
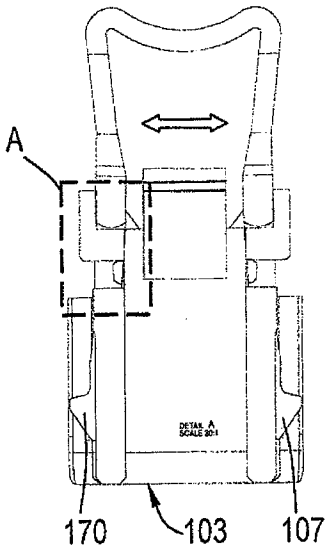
Figure 26:
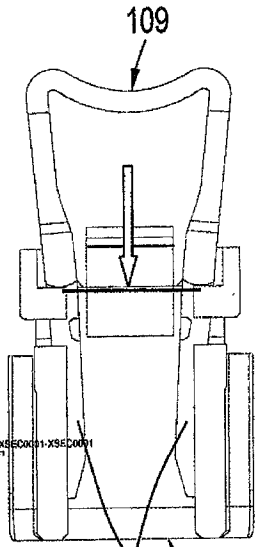
Figure 25:
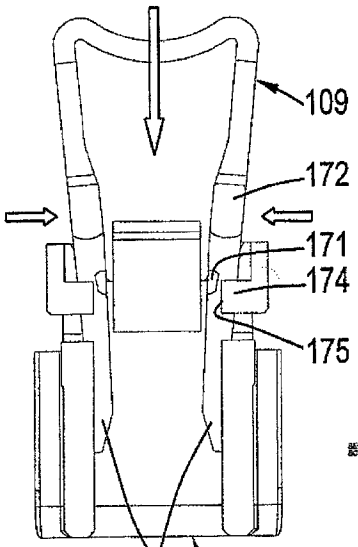
Figure 24:
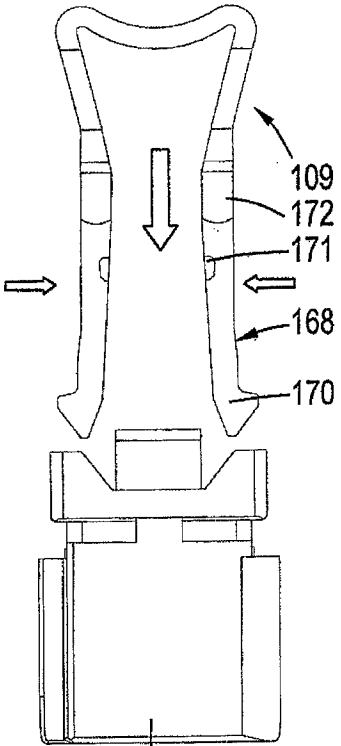
FIG. 24 is a side view of the locking spring of FIG. 21 and a terminal housing.

FIG. 24 is a side view of the locking spring 109 prior to being inserted into the terminal housing 103. FIGS. 25-27 show stages of the insertion process.

As seen in FIGS. 24-27, insertion of the locking spring 109 into the terminal housing 103 with the legs 168 pressed together (FIGS. 24-25) and until the enlarged contact projections 172 abut the rear surface 174A of the rib structure 174 (FIG. 26, abutment position indicated with a bold line) causes the locking tabs 171 to latch behind portions 174 of the housing 103 to retain the locking spring 109 in its longitudinal position on the terminal housing 103 (FIGS. 27, 27A), the portions 174 acting as a locking structure. To improve the easiness to assembly the cable connector 100 to the cable(s) 1, 2 or more precisely to assemble the covers 104 and 105, the locking tabs 171 keep the locking spring 109 latched in the housing 103, together with the projections 172 substantially fixing its position with respect to the rib structure 174 (FIGS. 27, 27A). But when the legs 168 are deflected inwards by the deflectable latches 112 of the covers 104, 105, the locking tabs 171 will come out of the latched position and will no longer keep the locking spring 109 in its longitudinal position (FIGS. 25, 26). A function which at this stage is taken over in an assembled connector 100 by hooks 119 (also referred to as integrated stops or protrusions) at the inside of the covers. 104 and 105, as shown in the cross sectional view of FIG. 40 of a connector 400B having a locking spring 409B and hooks 419B on the inside of covers 404B and 405B. Thus, the locking spring 109 (409B) may be mounted and kept in a substantially fixed position with respect to the terminal housing, both during and after assembly of the connector.

Figure 28:
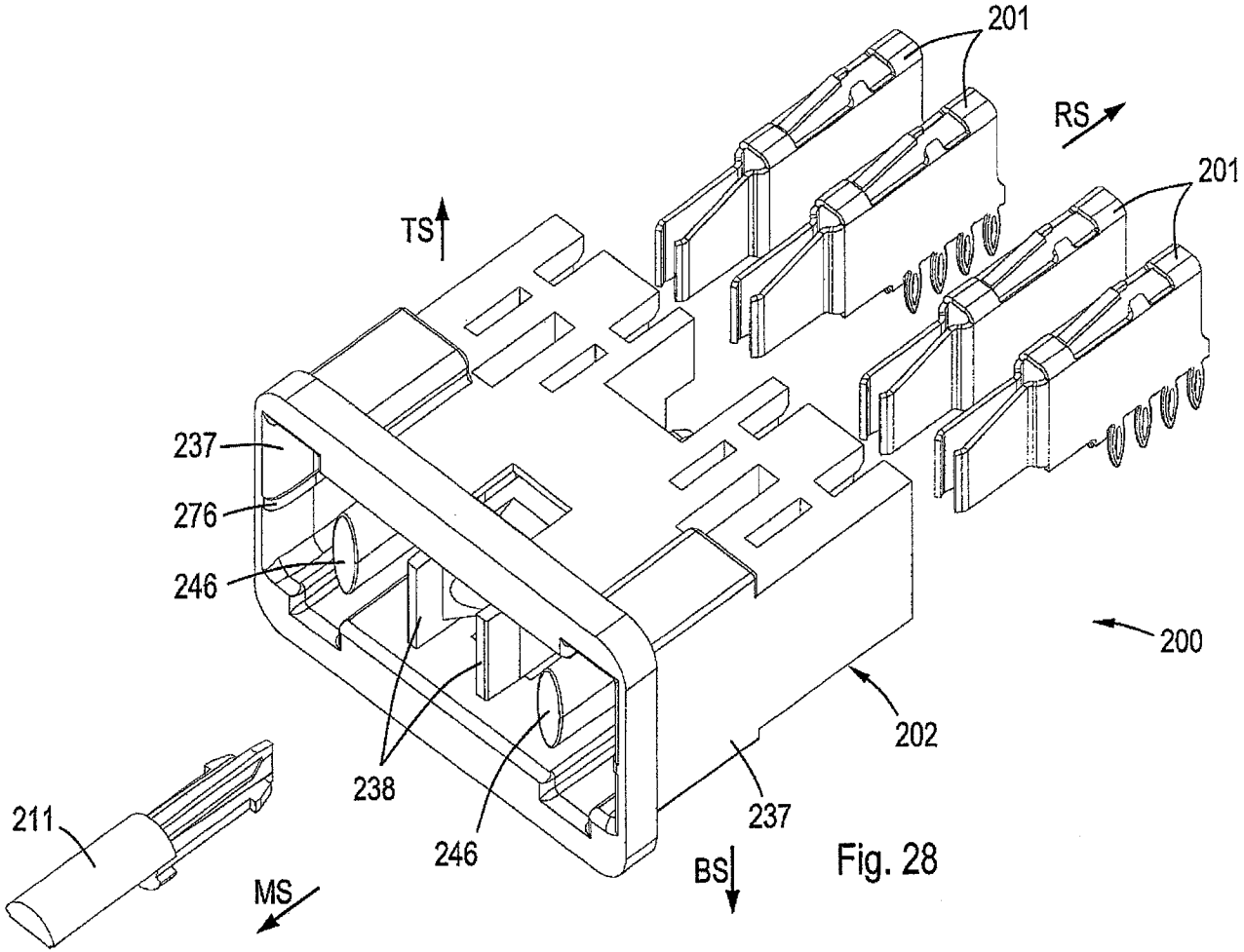
FIG. 28 is an exploded top perspective view of an improved board connector.
Figure 31:
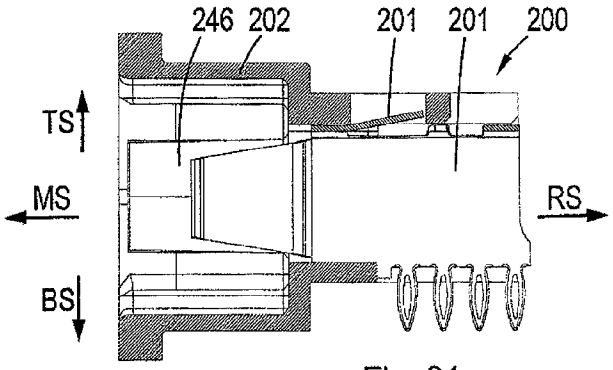
FIG. 31 is a cross sectional view of the connector of FIG. 30 along the plane XXXIII-XXXIII in FIG. 30.
Figure 30:
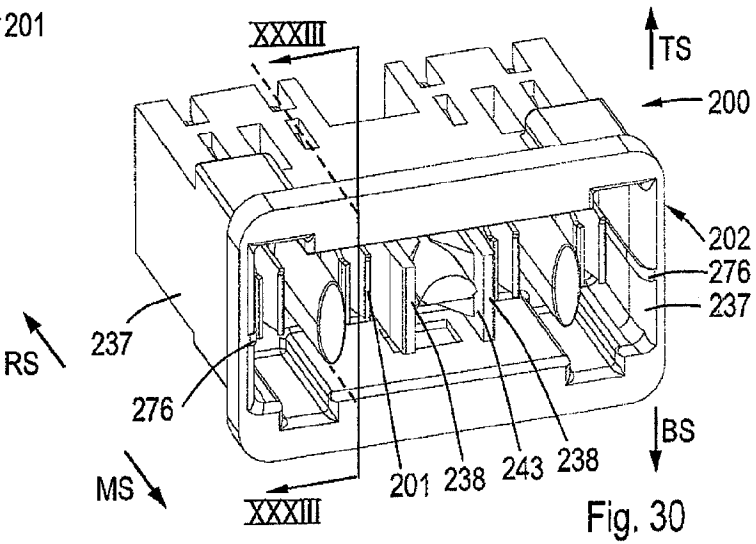
FIG. 30 is a perspective view of the connector of FIG. 28 in assembled state.
Figure 29:
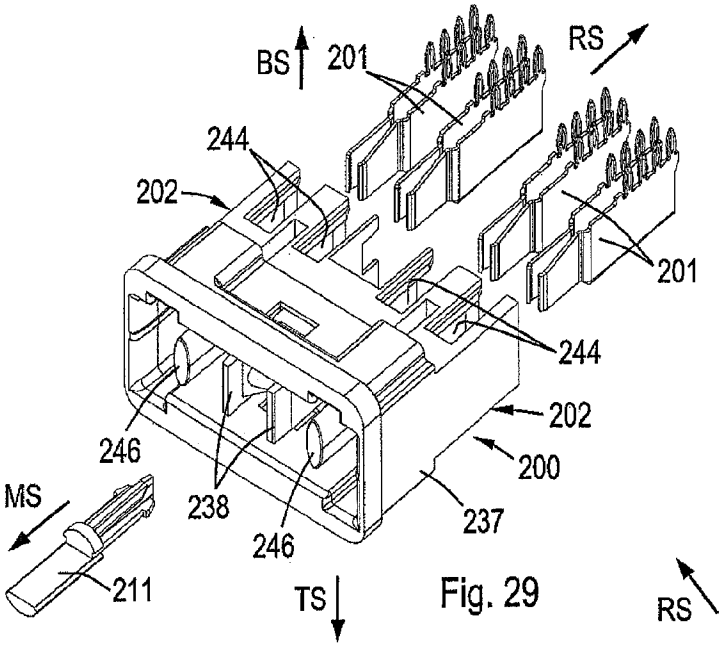
FIG. 29 is an exploded bottom perspective view of the connector of FIG. 28.

Referring now to FIGS. 28-31, one example of the mating electrical connector 200 is shown in the form of a board connector 200. FIGS. 28, 29 are explosion views of the connector 200, FIG. 30 is a perspective view and FIG. 31 is a cross sectional view according to the plane indicated at XXXII-XXXII in FIG. 30 in a direction from the mating side MS towards the rear side RS of the connector, midway a contact terminal 201. The mating electrical connector 200 generally comprises four contact terminals 201, a housing 202, and a coding key 211. The contact terminals 201 are male PWR TWIN BLADE® contacts. The housing 202 generally comprises a one piece molded plastic or polymer member. The housing 202 comprises four mounting areas 244 for mounting the four terminals 201, a relatively open front end aperture, a coding key mounting area 243, and two portions 246. The portions 246, as described above, separate the front ends of the terminals 201 from each other and form touch proof walls. Additional touch proof walls 238 are provided on opposite sides of the coding key mounting area 243.

Referring also to FIGS. 28-31, to make a wall more flexible it is important to get a good stress distribution. To get a good distribution it is necessary or at least desired that the wall is or substantially always will be displaced on the same, predefined and controlled location. By adding a small rib 276 on the side wall 237 of the connector 200 you will get a predefined and controlled location where the wall 237 will be displaced. This may also be done by adding a rib on the connector 100 which will be inserted, but on the board connector 200 is preferred. When a connector 100 is inserted/withdrawn to/from the board connector 200 the (side)walls 237 will guide the connector by the small rib 276. The forces on the (side)walls 237 will be on the small rib 276. By this way you get a reasonably well predictable or even generally good stress distribution and this can make the wall 237 less vulnerable for breaking. Other walls of one or both connectors may also be provided with a similar stress distribution structure or rib.

Referring to FIGS. 32 and 33 a portion of a connector 200 is shown, comprising a coding key mounting area 243 together with the adjacent side walls 238. The coding key mounting area 243 has a general ring shape 277 with an aperture 232 having eight ribs 233 for mounting the coding key 211 in one of eight angular positions. Portions of the housing 202 extend above the ring shaped section 277 from the inward sides of the touch proof walls 238 forming general "C" shaped ribs 278 which strengthen the walls 238.

FIGS. 34 and 35 are a perspective view and a plan front view of a mating connector 200' according to a previous design. In FIG. 35, a broken wall 238' is shown with its original location indicated with dashed lines. Referring to FIGS. 34-35, in the past the touch proof walls 238' did not have the strengthening ribs 278. Thus, as shown in FIG. 35, the walls 238' were easily broken since they were thin in respect to their length. The strengthening ribs 278 strengthen the walls 238 to help prevent breakage without interfering with mounting of the coding key 211 in the mounting area 243, and without having to increase the overall size of the housing 202. FIG. 36 shows an alternate embodiment wherein the strengthening rib 278A has a general ring shape and extends between the two walls 238.

It should be understood that the foregoing description is only illustrative of the invention. Various alternatives and modifications can be devised by those skilled in the art without departing from the invention.

The invention claimed is:

1. Connector having a rear side and a mating side, comprising a mounting aperture configured for accommodating a coding key, wherein the mounting aperture has a longitudinal axis in a direction from the rear side to the mating side and a plurality of ribs extending in a direction along the longitudinal axis forming grooves therebetween, and wherein at least some of the ribs each have a front end and a chamfer on a side wall of the rib, where the chamfer extends from the front end of the rib to a subsequent portion of the side wall such that the chamfer forms a sloped lead-in surface from the front end to the subsequent portion of the side wall, and where the chamfer has a substantial, triangle shape.

2. Connector according to claim 1, wherein each rib has chamfers on opposite side walls of the rib.

3. Connector according to claim 1, wherein the front end of the ribs forms a flat top end.

4. Connector according to claim 1, wherein the connector comprises walls extending in a direction from the rear side to the mating side and being provided with ribs arranged for at least partially enclosing the mounting aperture and for at least partially enclosing a coding key inserted in the aperture.

5. Connector having a rear side and a mating side, comprising a mounting aperture configured for accommodating a coding key, wherein the mounting aperture has a longitudinal axis in a direction from the rear side to the mating side and a plurality of ribs extending in a direction along the longitudinal axis forming grooves therebetween, and wherein at least some of the ribs have chamfers on a side wall of the rib wherein the connector comprises walls extending in a direction from the rear side to the mating side and being provided with ribs arranged for at least partially enclosing the mounting aperture and for at least partially enclosing a coding key inserted in the aperture, wherein at least a portion of the ribs extend towards one another to a point where they become one wall and form a substantially rigid tower around and in the direction of the coding key.

6. Connector having a rear side and a mating side, comprising a mounting aperture configured for accommodating a coding key, the connector comprising walls extending in a direction from the rear side to the mating side, where first ones of the walls form contact terminal spaces and spaced second ones of the walls are provided with ribs arranged for at least partially enclosing the mounting aperture and for at least partially enclosing a coding key inserted in the aperture, wherein the ribs extend towards one another to a point where they become one wall, and where the second walls and the ribs form a substantially rigid tower around and in the direction of the coding key.

7. Connector according to claim 6, wherein the mounting aperture has a longitudinal axis in a direction from the rear side to the mating side and the ribs extend in a direction along the longitudinal axis forming grooves therebetween, and wherein at least some of the ribs have substantially triangle shaped chamfers on side walls of the ribs.

8. Connector according to claim 7, wherein each rib has chamfers on opposite side walls of the rib.

9. Connector according to claim 7, wherein at least some of the ribs have a flat top end.

10. Coding key for a connector according to claim 1, having a front portion and a rear portion arranged along a longitudinal axis, wherein the rear portion comprises a plurality of deflectable snap lock legs extending substantially in the direction of the longitudinal axis and a support structure in-between the legs.

11. Coding key according to claim 10, wherein the support structure has a substantially elongated portion extending in a plane in-between two legs.

12. Coding key according to claim 10, wherein the support structure extends beyond the legs in at least one of a direction substantially parallel and a direction substantially perpendicular to the direction of the longitudinal axis.

13. Coding key according to claim 10, wherein the support structure has a number of ribs extending in a direction along the longitudinal axis and forming grooves or slots between the ribs.

14. Coding key according to claim 10, wherein the support structure has one or more chamfers at the end of the rear portion.

15. Coding key according to claim 10, wherein the front portion of the coding key has a substantially semi-circular cross-section.

16. Connector having a rear side and a mating side, comprising a mounting aperture configured for accommodating a coding key, wherein the mounting aperture has a longitudinal axis in a direction from the rear side to the mating side and a plurality of ribs extending in a direction along the longitudinal axis forming grooves therebetween, and wherein each of the ribs has a flat top end and chamfers on opposite side walls, where the chamfers extend from the flat top end of the ribs to a subsequent portion of the side walls such that the chamfers form sloped lead-in surfaces from the flat top end to the subsequent portions of the side walls, and wherein the connector comprises walls extending in a direction from the rear side to the mating side and being provided with the ribs arranged for at least partially enclosing the mounting aperture and for at least partially enclosing a coding key inserted in the aperture.

17. Coding key for a connector, having a front portion and a rear portion arranged along a longitudinal axis, wherein the rear portion comprises a plurality of deflectable snap lock legs extending substantially in the direction of the longitudinal axis and a support structure in-between the legs having a substantially elongated portion extending in a plane in-between two legs which extends beyond the legs in at least one of a direction substantially parallel and a direction substantially perpendicular to the direction of the longitudinal axis and which support structure has a number of ribs extending in a direction along the longitudinal axis and forming grooves or slots between the ribs.

18. Connector according to claim 16 where the ribs comprise at least four of the ribs arranged in a ring shape with at least four of the groves formed between the ribs.

* * * * *